US011018456B2

(12) United States Patent
Trout et al.

(10) Patent No.: US 11,018,456 B2
(45) Date of Patent: May 25, 2021

(54) CONTACT MODULE FOR A CONNECTOR ASSEMBLY

(71) Applicants: TE CONNECTIVITY CORPORATION, Berwyn, PA (US); TYCO ELECTRONICS JAPAN G.K., Kawasaki (JP)

(72) Inventors: David Allison Trout, Lancaster, PA (US); Douglas Edward Shirk, Elizabethtown, PA (US); Justin Dennis Pickel, Hummelstown, PA (US); Timothy Robert Minnick, Enola, PA (US); Margaret Mahoney Fernandes, West Chester, PA (US); Tetsuya Katano, Kanagawa (JP); Masayuki Aizawa, Machida (JP)

(73) Assignees: TE CONNECTIVITY CORPORATION, Berwyn, PA (US); TYCO ELECTRONICS JAPAN G.K., Kawasaki (JP)

( * ) Notice: Subject to any disclaimer, the term of this patent is extended or adjusted under 35 U.S.C. 154(b) by 0 days.

(21) Appl. No.: 16/522,760

(22) Filed: Jul. 26, 2019

(65) Prior Publication Data

US 2021/0028582 A1 Jan. 28, 2021

(51) Int. Cl.
*H01R 13/6586* (2011.01)
*H01R 13/6461* (2011.01)
(Continued)

(52) U.S. Cl.
CPC ..... *H01R 13/6586* (2013.01); *H01R 13/514* (2013.01); *H01R 13/6461* (2013.01);
(Continued)

(58) Field of Classification Search
CPC ..... H01R 13/6585; H01R 12/724; H01R 13/6587; H01R 13/514; H01R 13/6461;
(Continued)

(56) References Cited

U.S. PATENT DOCUMENTS 6,146,202 A * 11/2000 Ramey ..... H01R 12/585 439/607.1
7,771,233 B2 8/2010 Gailus
(Continued)

OTHER PUBLICATIONS

U.S. Appl. No. 15/936,631, filed Mar. 27, 2018, entitled "Electrical Connector With Insertion Loss Control Window in a Contact Module" (29 pages).

*Primary Examiner* — Abdullah A Riyami
*Assistant Examiner* — Justin M Kratt

(57) ABSTRACT

A contact module includes a leadframe having signal contacts arranged in pairs. Each signal contact includes a lead having sides extending between inner and outer edges. The contact module includes a dielectric frame supporting the leadframe having a first side and a second side with windows extending through the dielectric frame between the first side and the second side. The windows exposing to air the sides, the inner edges and the outer edges of the corresponding leads along a majority of lengths of the leads. The contact module includes a shield structure having a first ground shield at the first side and a second ground shield at the second side to provide electrical shielding for the signal contacts.

23 Claims, 10 Drawing Sheets

(51) Int. Cl.

| | |
|---|---|
| ***H01R 13/514*** | (2006.01) |
| *H01R 107/00* | (2006.01) |
| *H01R 13/6587* | (2011.01) |
| *H01R 12/73* | (2011.01) |
| *H01R 9/24* | (2006.01) |
| *H01R 12/72* | (2011.01) |
| *H01R 13/658* | (2011.01) |
| *H01R 13/6473* | (2011.01) |
| *H01R 13/6585* | (2011.01) |
| *H01R 13/6581* | (2011.01) |

(52) U.S. Cl.
CPC ..... *H01R 9/2408* (2013.01); *H01R 12/724* (2013.01); *H01R 12/727* (2013.01); *H01R 12/737* (2013.01); *H01R 13/6473* (2013.01); *H01R 13/658* (2013.01); *H01R 13/6581* (2013.01); *H01R 13/6585* (2013.01); *H01R 13/6587* (2013.01); *H01R 2107/00* (2013.01)

(58) Field of Classification Search
CPC ..... H01R 13/6586; H01R 13/6581; H01R 12/737; H01R 13/6473; H01R 12/727; H01R 13/658; H01R 9/2408; H01R 2107/00
USPC ..... 439/607.05, 607.06, 607.07, 607.08, 439/607.09, 607.11, 607.39, 701
See application file for complete search history.

(56) References Cited

U.S. PATENT DOCUMENTS

| | | | | |
|---|---|---|---|---|
| 7,794,278 | B2 * | 9/2010 | Cohen | H01R 12/727 439/108 |
| 8,262,412 | B1 | 9/2012 | Minnick et al. | |
| 8,366,485 | B2 | 2/2013 | Johnescu et al. | |
| 8,398,431 | B1 | 3/2013 | Whiteman, Jr. et al. | |
| 8,771,016 | B2 | 7/2014 | Atkinson et al. | |
| 8,998,642 | B2 | 4/2015 | Manter et al. | |
| 9,666,998 | B1 | 5/2017 | de Boer et al. | |
| 9,917,406 | B1 * | 3/2018 | Iwasaki | H01R 13/6587 |
| 10,186,811 | B1 | 1/2019 | Trout et al. | |
| 2005/0009402 | A1 * | 1/2005 | Chien | H01R 12/716 439/607.13 |
| 2006/0068640 | A1 * | 3/2006 | Gailus | H01R 12/721 439/607.08 |
| 2009/0093158 | A1 * | 4/2009 | McAlonis | H01R 13/6586 439/607.41 |
| 2012/0184140 | A1 | 7/2012 | Davis et al. | |
| 2014/0087589 | A1 * | 3/2014 | Yu | H01R 13/6599 439/607.02 |
| 2015/0236452 | A1 * | 8/2015 | Cartier, Jr. | H01R 13/518 439/607.02 |
| 2019/0020155 | A1 | 1/2019 | Trout et al. | |

* cited by examiner

CONTACT MODULE FOR A CONNECTOR ASSEMBLY

BACKGROUND OF THE INVENTION

The subject matter herein relates generally to connector assemblies.

Some electrical systems utilize connector assemblies, such as header assemblies and receptacle assemblies, to interconnect two circuit boards, such as a motherboard and daughtercard. The connector assemblies include contact modules having contacts terminated to the circuit boards. High speed connector assemblies suffer from problems with cross talk and can exhibit higher than desirable insertion loss due to geometries of the signal contacts and the shield structure for the connector assemblies. For example, gaps or spaces in shielding through the connector assembly can result in reduced connector performance. Additionally, contact modules have problems with electrical skew due to contacts having different lengths. Some known connector assemblies provide conductive holders for each contact module that provides 360° shielding for each pair of signal contacts along the entire lengths of the signal transmission lines. For example, the contact modules include plated plastic shells that hold each leadframe. However, the plated plastic shells are expensive to manufacture.

A need remains for a cost effective and reliable contact module having improved electrical performance.

BRIEF DESCRIPTION OF THE INVENTION

In one embodiment, a contact module for a connector assembly is provided. The contact module includes a leadframe having first signal contacts arranged in pairs. Each first signal contact has a mating end configured to be mated to a mating connector assembly and a mounting end configured to be terminated to a circuit board. Each first signal contact has a first lead extending between the mating end and the mounting end. The first lead has sides extending between an inner edge and an outer edge. The contact module includes a dielectric frame supporting the leadframe. The dielectric frame has a first side and a second side. The dielectric frame has windows extending through the dielectric frame between the first side and the second side. The windows exposing to air the sides, the inner edges and the outer edges of the corresponding first leads along a majority of lengths of the first leads. The contact module includes a shield structure having a first ground shield at the first side and a second ground shield at the second side. The first and second ground shields provide electrical shielding for the first signal contacts.

In another embodiment, a contact module for a connector assembly is provided. The contact module includes a leadframe having first signal contacts arranged in pairs. Each first signal contact has a mating end configured to be mated to a mating connector assembly and a mounting end configured to be terminated to a circuit board. Each first signal contact has a first lead extending between the mating end and the mounting end. The first lead has sides extending between an inner edge and an outer edge. The contact module includes a dielectric frame supporting the leadframe. The dielectric frame has a first side and a second side. The dielectric frame has an inner hub and an outer rail. The dielectric frame has connecting rails extending between the inner hub and the outer rail. The dielectric frame has cross-rails between the connecting rails. The dielectric frame has windows extending through the dielectric frame between the first side and the second side. The windows are bound by corresponding connecting rails and cross-rails. The windows expose the first leads to air. The dielectric frame has first securing posts extending from the inner hub, the outer rail, and the connecting rails. The dielectric frame has first securing posts extending from the inner hub, the outer rail, and the connecting rails. The contact module includes a shield structure having a first ground shield at the first side and a second ground shield at the second side. The first ground shield includes securing post openings receiving first securing posts. The second ground shield includes securing post openings receiving second securing posts. The first and second ground shields provide electrical shielding for the first signal contacts.

In a further embodiment, a connector assembly is provided. The connector assembly includes a housing having a mating end configured to be mated with a mating connector assembly. The housing has a cavity. The connector assembly includes contact modules received in the cavity. The contact modules are configured to be mated with the mating connector assembly. The contact modules are configured to be mounted to a circuit board. Each contact module includes a leadframe having first signal contacts arranged in pairs. Each first signal contact has a mating end configured to be mated to a mating connector assembly and a mounting end configured to be terminated to a circuit board. Each first signal contact has a first lead extending between the mating end and the mounting end. The first lead has sides extending between an inner edge and an outer edge. The contact module includes a dielectric frame supporting the leadframe. The dielectric frame has a first side and a second side. The dielectric frame has an inner hub and an outer rail. The dielectric frame has connecting rails extending between the inner hub and the outer rail. The dielectric frame has cross-rails between the connecting rails. The dielectric frame has windows extending through the dielectric frame between the first side and the second side. The windows are bound by corresponding connecting rails and cross-rails. The windows expose to air the sides, the inner edges and the outer edges of the corresponding first leads along a majority of lengths of the first leads. The dielectric frame has first securing posts extending from the inner hub, the outer rail, and the connecting rails. The dielectric frame has first securing posts extending from the inner hub, the outer rail, and the connecting rails. The contact module includes a shield structure having a first ground shield at the first side and a second ground shield at the second side. The first ground shield includes securing post openings receiving first securing posts. The second ground shield includes securing post openings receiving second securing posts. The first and second ground shields provide electrical shielding for the first signal contacts.

In another embodiment, a contact module is provided for a connector assembly including a first frame assembly and a second frame assembly. The first frame assembly includes a first leadframe and a first dielectric frame, the first leadframe having first signal contacts, each first signal contact having a mating end configured to be mated to a mating connector assembly and a mounting end configured to be terminated to a circuit board, each first signal contact having a first lead extending between the mating end and the mounting end, the first lead having sides extending between an inner edge and an outer edge, the first dielectric frame supporting the first leadframe, the first dielectric frame having an inner side and an outer side, the outer side defining a first side of the contact module, the first dielectric frame having windows extending through the first dielectric frame between the inner side and the outer side, the windows of the first dielectric frame exposing to air the sides, the inner edges and the outer edges of the corresponding first leads along a majority of lengths of the first leads. The second frame assembly includes a second leadframe and a second dielectric frame, the second leadframe having second signal contacts aligned with first signal contacts of the first leadframe in pairs, each second signal contact having a mating end configured to be mated to the mating connector assembly and a mounting end configured to be terminated to the circuit board, each second signal contact having a second lead extending between the mating end and the mounting end, the second lead having sides extending between an inner edge and an outer edge, the second dielectric frame supporting the second leadframe, the second dielectric frame having an inner side and an outer side defining a second side of the contact module, the inner side of the second dielectric frame facing the inner side of the first dielectric frame, the second dielectric frame having windows extending through the second dielectric frame between the inner side and the outer side, the windows of the second dielectric frame exposing to air the sides, the inner edges and the outer edges of the corresponding second leads along a majority of lengths of the second leads, the windows of the second dielectric frame being aligned with and open to the windows of the first dielectric frame. The contact module includes a shield structure having a first ground shield coupled to the first side and a second ground shield coupled to the second side, the first and second ground shields providing electrical shielding for the first and second signal contacts.

DETAILED DESCRIPTION OF THE INVENTION

Figure 1:
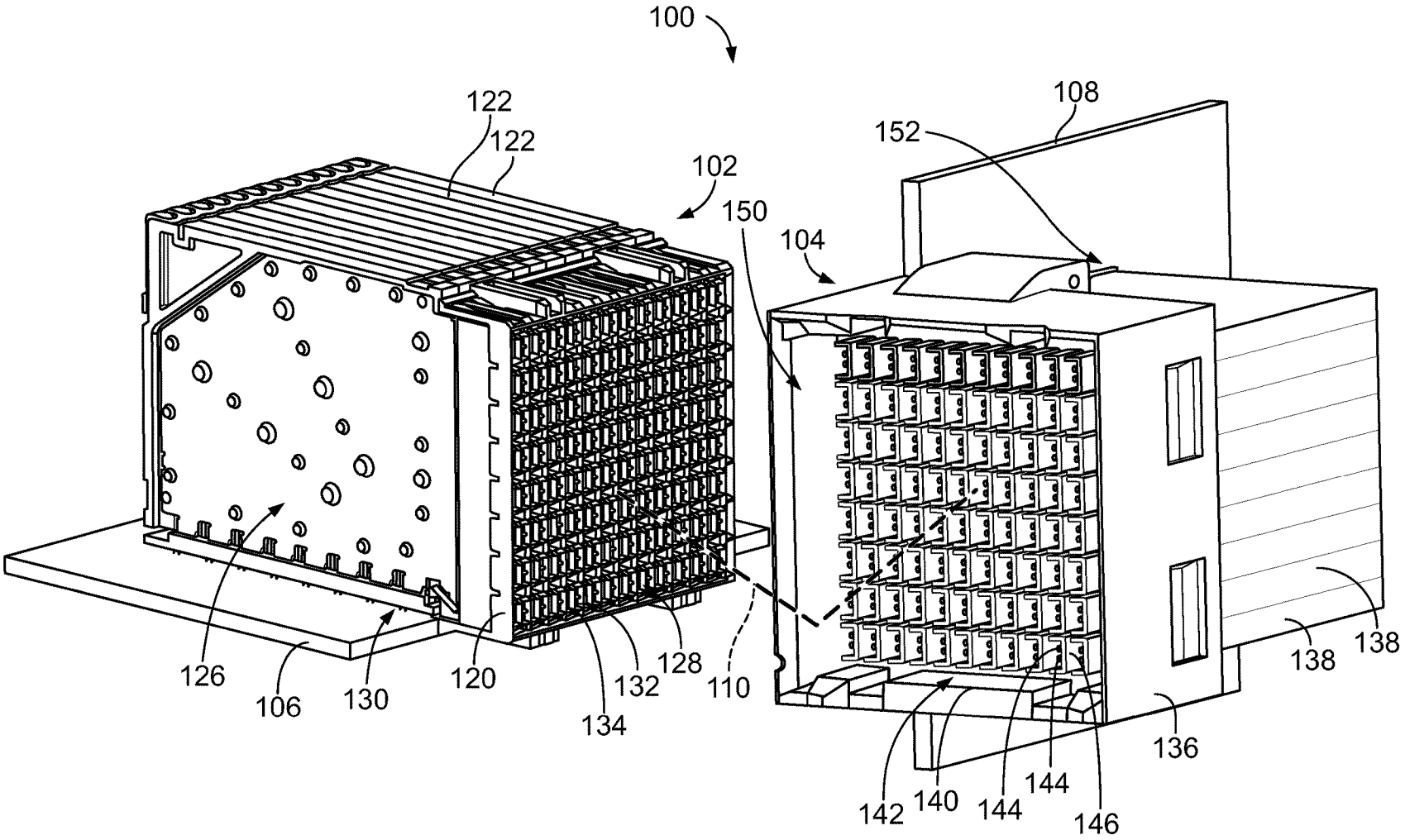
FIG. 1 is a perspective view of an exemplary embodiment of an electrical connector system showing electrical connectors having contact modules.

FIG. 1 is a perspective view of an exemplary embodiment of an electrical connector system 100 illustrating a first connector assembly 102 and a second connector assembly 104 that may be directly mated together. The first connector assembly 102 and/or the second connector assembly 104 may be referred to hereinafter individually as a "connector assembly" or collectively as "connector assemblies". The first connector assembly 102 or the second connector assembly 104 may be a receptacle assembly and the first connector assembly 102 or the second connector assembly 104 may be a header assembly. In the description, the first connector assembly 102 and corresponding components may be referred to as a receptacle assembly or receptacle components and the second connector assembly 104 and corresponding components may be referred to as a header assembly or header components.

The first and second connector assemblies 102, 104 are each electrically connected to respective circuit boards 106, 108. The first and second connector assemblies 102, 104 are utilized to electrically connect the circuit boards 106, 108 to one another at a separable mating interface. In an exemplary embodiment, the circuit boards 106, 108 are oriented perpendicular to one another when the first and second connector assemblies 102, 104 are mated. Alternative orientations of the circuit boards 106, 108 are possible in alternative embodiments.

A mating axis 110 extends through the first and second connector assemblies 102, 104. The first and second connector assemblies 102, 104 are mated together in a direction parallel to and along the mating axis 110.

The first connector assembly 102 includes a housing 120 that holds a plurality of contact modules 122. Any number of contact modules 122 may be provided to increase the signal pin count of the first connector assembly 102. The contact modules 122 each include a plurality of signal contacts 124 (shown in FIG. 2) that are received in the housing 120 for mating with the second connector assembly 104. In an exemplary embodiment, the signal contacts 124 are arranged in pairs defining differential pairs. In the illustrated embodiment, the pairs of signal contacts 124 are arranged in columns defining a pair-in-column connector interface. In an exemplary embodiment, each contact module 122 has a shield structure 126 for providing electrical shielding for the signal contacts 124. In an exemplary embodiment, the shield structure 126 is electrically connected to the second connector assembly 104 and/or the circuit board 106. For example, the shield structure 126 may be electrically connected to the second connector assembly 104 by extensions (e.g. beams or fingers) extending from the contact modules 122 that engage the second connector assembly 104. The shield structure 126 may be electrically connected to the circuit board 106 by features, such as ground pins.

The first connector assembly 102 includes a mating end 128 and a mounting end 130. The signal contacts 124 are received in the housing 120 and held therein at the mating end 128, such as for mating to the second connector assembly 104. In other embodiments, the mating end 128 may be mated to another component, such as a circuit board. The signal contacts 124 are arranged in a matrix of rows and columns. In the illustrated embodiment, at the mating end 128, the rows are oriented horizontally and the columns are oriented vertically. Other orientations are possible in alternative embodiments. Any number of signal contacts 124 may be provided in the rows and columns. The signal contacts 124 also extend to the mounting end 130 for mounting to an electrical component, such as the circuit board 106. In other embodiments, the mounting end 130 may be mounted to another electrical component, such as an electrical connector. Optionally, the mounting end 130 may be substantially perpendicular to the mating end 128.

The housing 120 includes a plurality of signal contact openings 132 and a plurality of ground contact openings 134 at the mating end 128. The signal contacts 124 are received in corresponding signal contact openings 132. Optionally, a single signal contact 124 is received in each signal contact opening 132. The signal contact openings 132 may also receive corresponding signal contacts 144 therein when the first and second connector assemblies 102, 104 are mated. The ground contact openings 134 receive ground shields 146 therein when the first and second connector assemblies 102, 104 are mated. The ground contact openings 134 receive grounding beams 302 (shown in FIG. 2) of the shield structure 126 of the contact modules 122 that mate with the ground shields 146 to electrically common the first and second connector assemblies 102, 104.

The housing 120 is manufactured from a dielectric material, such as a plastic material, and provides isolation between the signal contact openings 132 and the ground contact openings 134. The housing 120 isolates the signal contacts 124 and the signal contacts 144 from the ground shields 146. The housing 120 isolates each set of signal contacts 124, 144 from other sets of signal contacts 124, 144.

The second connector assembly 104 includes a housing 136 holding contact modules 138. The housing 136 has walls 140 defining a chamber 142 at a mating end 150 of the second connector assembly 104. A mounting end 152 of the second connector assembly is mounted to an electrical component, such as the circuit board 108. In other embodiments, the mounting end 152 may be mounted to another electrical component, such as an electrical connector. Optionally, the mounting end 152 may be substantially perpendicular to the mating end 150. In the illustrated embodiment, the first connector assembly 102 is coupled to the mating end 150, such as being received in the chamber 142 through the mating end 150. In other embodiments, the mating end 150 may be mated to another component, such as a circuit board. The housing 120 engages the walls 140 to hold the first connector assembly 102 in the chamber 142. The signal contacts 144 and the ground shields 146 extend into the chamber 142. In an exemplary embodiment, the signal contacts 144 are arranged as differential pairs. In the illustrated embodiment, the pairs of signal contacts 144 are arranged in rows defining a pair-in-row connector interface. The ground shields 146 are positioned between the differential pairs to provide electrical shielding between adjacent differential pairs. In the illustrated embodiment, the ground shields 146 are C-shaped and provide shielding on three sides of the pair of signal contacts 144. Other shapes are possible in alternative embodiments.

Figure 2:
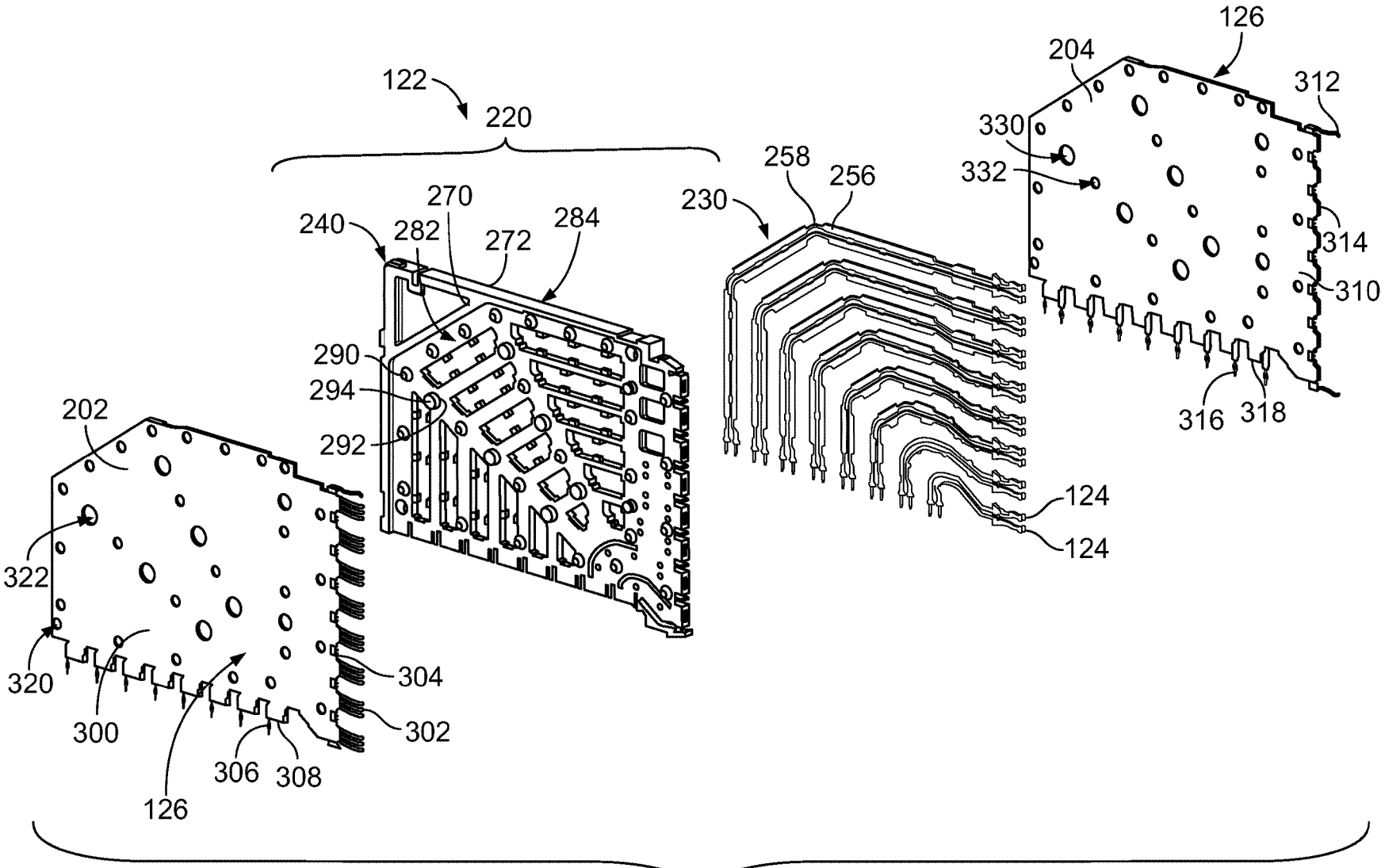
FIG. 2 is an exploded view of one of the contact modules in accordance with an exemplary embodiment.

FIG. 2 is an exploded view of one of the contact modules 122 and part of the shield structure 126. The shield structure 126 includes a first ground shield 202 and a second ground shield 204. The first and the second ground shields 202, 204 electrically connect the contact module 122 to the ground shields 146 (shown in FIG. 1). The first and the second ground shields 202, 204 provide electrical shielding on both sides of the signal contacts 124. In an exemplary embodiment, the first and second ground shields 202, 204 are configured to be closely coupled to the signal contacts 124 to provide electrical shielding between pairs of the signal contacts 124 without being physically located between the pairs of signal contacts 124. The first ground shield 202 is provided at a first side of the contact module 122 and the second ground shield 204 is provided at a second side of the contact module 122. In various embodiments, the first ground shield is coupled to the first side of the contact module 122 and the second ground shield 204 is coupled to the second side of the contact module 122.

The contact module 122 includes a frame assembly 220 including a leadframe 230 and a dielectric frame 240. The leadframe 230 defines the signal contacts 124. The leadframe 230 is a stamped and formed structure. The dielectric frame 240 surrounds and supports the signal contacts 124 of the leadframe 230. For example, the dielectric frame 240 may be an overmolded body configured to be overmolded around the leadframe 230 to form the dielectric frame 240. Other manufacturing processes may be utilized to form the contact modules 122, such as loading signal contacts 124 into a formed dielectric body. The signal contacts 124 are shaped and positioned for enhanced electrical performance at high data speed, such as to reduce cross-talk, reduce insertion loss, reduce skew, match target impedance, and the like. The dielectric frame 240 is positioned relative to the leadframe 230 for enhanced electrical performance at high data speeds, such as to reduce cross-talk, reduce insertion loss, reduce effects of skew, achieve target impedance, and the like.

Figure 3:
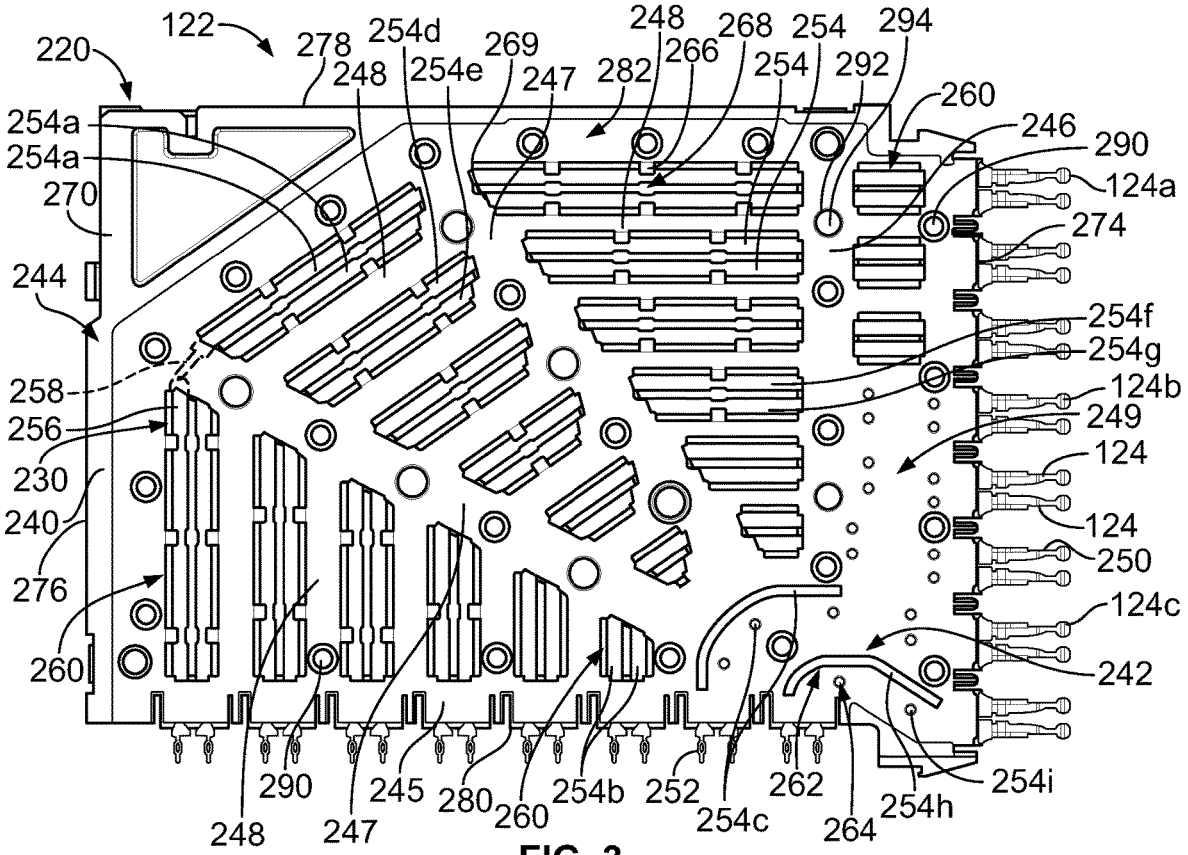
FIG. 3 is a side view of a first side of the contact module (without the ground shield) in accordance with an exemplary embodiment.
Figure 4:
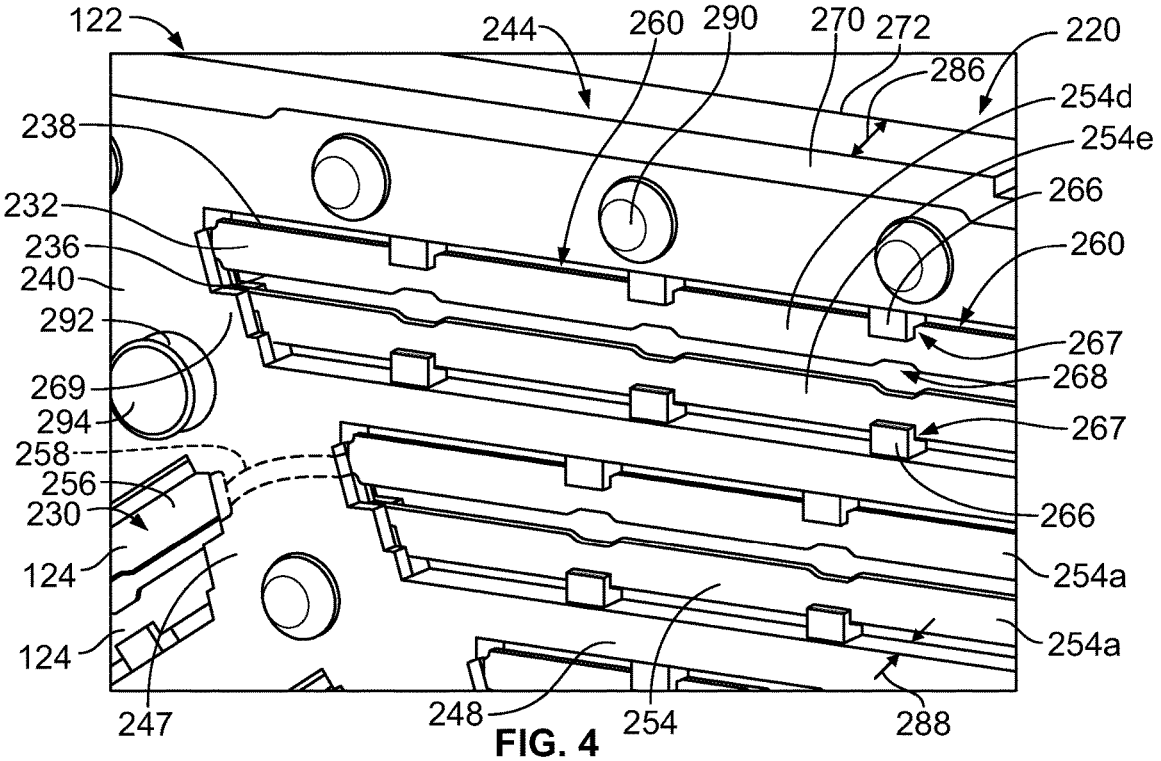
FIG. 4 is a perspective view of a portion of the first side of the contact module in accordance with an exemplary embodiment.
Figure 5:
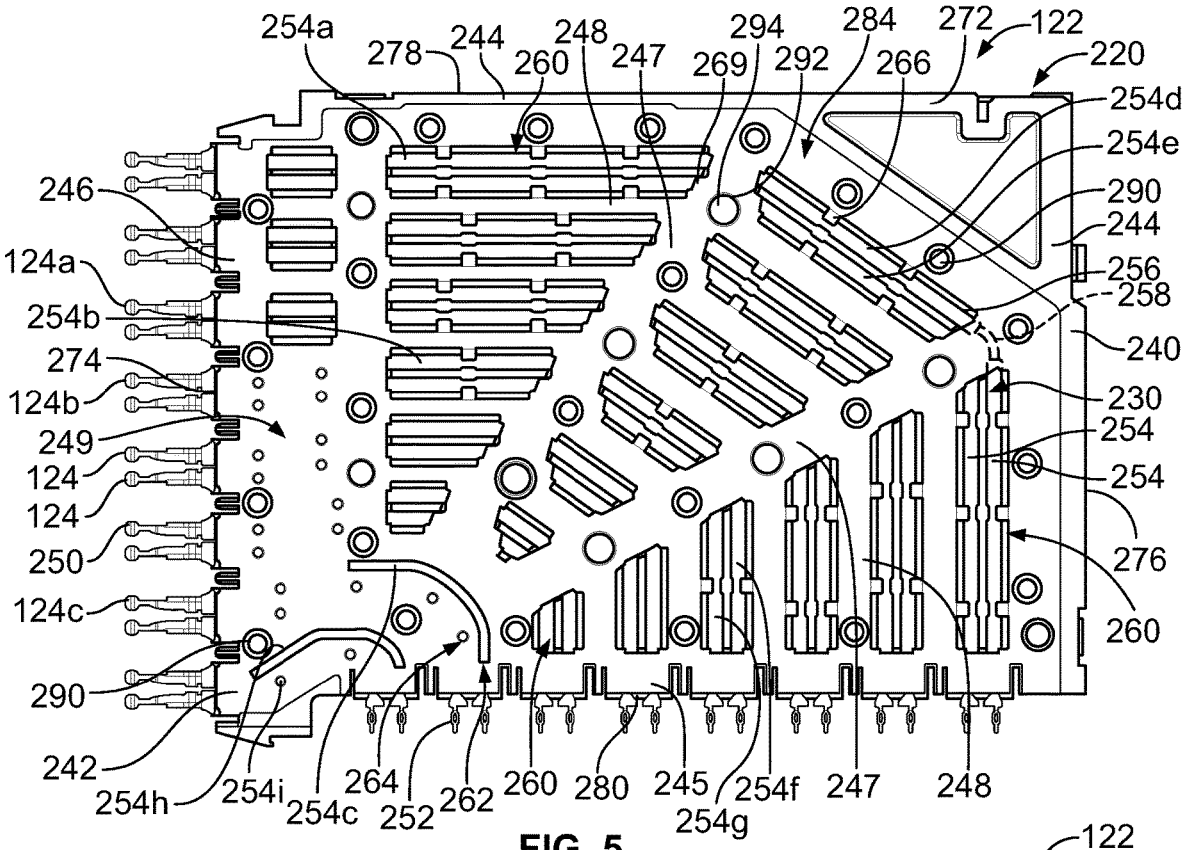
FIG. 5 is a side view of a second side of the contact module (without the ground shield) in accordance with an exemplary embodiment.
Figure 6:
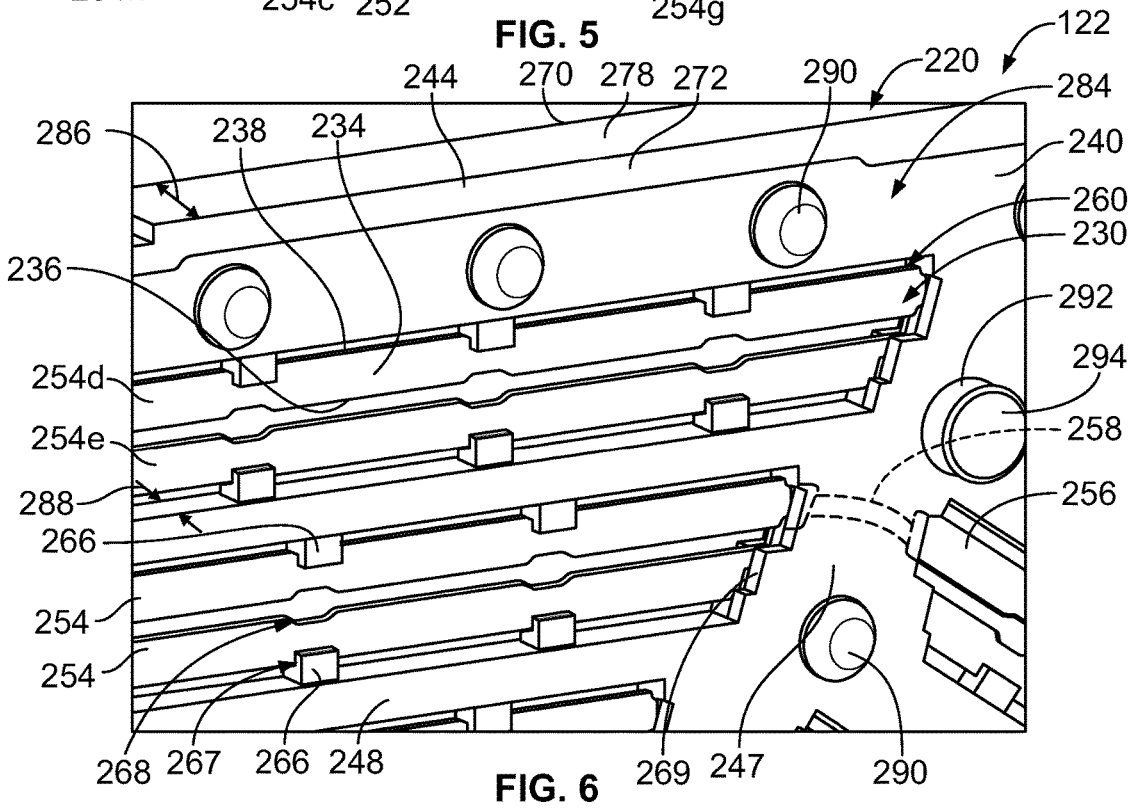
FIG. 6 is a perspective view of a portion of the second side of the contact module in accordance with an exemplary embodiment.

FIG. 3 is a side view of a first side of the contact module 122 in accordance with an exemplary embodiment. FIG. 4 is a perspective view of the first side of the contact module 122 in accordance with an exemplary embodiment. FIG. 5 is a side view of a second side of the contact module 122 in accordance with an exemplary embodiment. FIG. 6 is a perspective view of the second side of the contact module 122 in accordance with an exemplary embodiment.

The dielectric frame 240 includes frame members holding the signal contacts 124. For example, the dielectric frame 240 includes an inner hub 242 at a radially inner portion (for example, at the intersection of the front and the bottom) of the dielectric frame 240 and an outer rail 244 at a radially outer portion of the dielectric frame 240. The dielectric frame 240 includes a bottom rail 245 between the inner hub 242 and the outer rail 244. The dielectric frame 240 includes a front rail 246 between the inner hub 242 and the outer rail 244. The dielectric frame 240 includes other frame members extending from the inner hub 242 and/or the outer rail 244 and/or the bottom rail 245 and/or the front rail 246 and/or other frame members to hold the signal contacts 124. For example, the dielectric frame 240 includes connecting rails 247 extending between the inner hub 242 and the outer rail 244 and cross-rails 248 extending between the connecting rails 247 or between the bottom rail 245 and the connecting rail 247 or between the front rail 246 and the connecting rail 247. The dielectric frame 240 includes closing rails 249 completely filling spaces between other rails or frame members. For example, the closing rails 249 may be located at or near the inner hub 242. In an exemplary embodiment, the frame members encase portions or segments of the signal contacts 124 and the dielectric frame 240 includes openings that exposes portions or segments of the signal contacts 124.

The signal contacts 124 have mating portions 250 extending forward from the front rail 246 and mounting portions 252 extending from the bottom rail 245. The signal contacts 124 include leads 254 extending between the mating portions 250 and the mounting portions 252. The leads 254 extend along generally parallel paths or segments through the frame assembly 220 between the mating portions 250 and the mounting portions 252. The mating portions 250 extend from the dielectric frame 240 for mating with the second connector assembly 104 (shown in FIG. 1). The mounting portions 252 extend from the dielectric frame 240 for mounting to the circuit board 106 (shown in FIG. 1). For example, the mounting portions 252 may be compliant pins, such as eye-of-the-needle pins. Other types of mounting portions 252 may be provided in alternative embodiments, such as solder tails, spring beams, and the like. In an exemplary embodiment, the mating portions 250 extend generally perpendicular with respect to the mounting portions 252. Each of the lead 254 includes opposite sides 232, 234 and an inner edge 246 opposite an outer edge 238 (shown in FIGS. 4 and 6).

In an exemplary embodiment, the leads 254 have different lengths between the mating portions 250 and the mounting portions 252. For example, the leads 254 located at or near the inner hub 242 are relatively shorter and the leads 254 located at or near the outer rail 244 are relatively longer. In an exemplary embodiment, for increased electrical performance of the signal transmission lines of the contact module 122, the dielectric frame 240 includes compensation features to compensate for the different lengths of the leads 254. For example, the dielectric frame 240 includes windows 260 used to expose corresponding leads 254 to air and trenches 262 used to expose corresponding leads 254 to air. Optionally, the dielectric frame 240 may include pinch point openings 264 in the inner hub 242, the closing rail 249, or other frame members formed at pinch point used to hold the leads 254 during overmolding of the dielectric frame 240. The pinch point openings 264 are smaller than the windows 260 and the trenches 262 and expose small areas of the leads 254 to air.

In various embodiments, the number of windows 260 and the lengths of the windows 260 may be different for different leads 254. The windows 260 expose both of the leads 254 within a pair (within the same window 260). In an exemplary embodiment, the leads 254 include pads 256 and bridges 258 (shown in phantom, also shown in FIG. 2) between the pads 256. The pads 256 are wider than the bridges 258. The pads 256 are located along portions of the leads 254 exposed within the windows 260. The bridges 258 are provided along portions of the leads 254 that extend through the frame members, such as the bottom rail 245, the front rail 246, the connecting rail 247, the closing rail 249 and the inner hub 242. The pads 256 are wider to control impedance due to the lower relative dielectric constant of air compared to plastic. The bridges 258 are narrower to provide compensation along the signal transmission lines where the leads 254 pass through the plastic material of the dielectric frame 240 as opposed to the air in the windows 260.

In an exemplary embodiment, the leads 254 may be arranged in different groups or sets based on the lengths of the leads 254. For example, the leads 254 may be grouped in three sets, with a first set of the leads 254 being the longest length leads (from mounting end to mating end), a second set of the leads 254 being of intermediate length, and a third set of the leads 254 having the shortest lead length. The first set includes first signal contacts 124*a* having first leads 254*a*. The second set includes second signal contacts 124*b* having second leads 254*b*. The third set includes a third signal contacts 124*c* having third leads 254*c*. The first signal contacts 124*a* are arranged in pairs with the first leads 254*a* of each pair including a longer first lead 254*d* and a shorter first lead 254*e*. Similarly, the second leads 254*b* are arranged in pairs each including a longer second lead 254*f* and a shorter second lead 254*g* and the third leads 254*c* are arranged in pairs each including a longer third lead 254*h* and a shorter third lead 254*i*. In the illustrated embodiment, the outer most three pairs are in the first set, the innermost two pairs are in the third set, and the intermediate three pairs are in the second set; however the sets may include greater or fewer pairs in alternative embodiments.

The windows 260 extend through the dielectric frame 240 between the frame members. The windows 260 are bounded by corresponding frame members, such as the bottom rail 245, the front rail 246, the connecting rail 247, the cross-rail 248, the closing rail 249 and the inner hub 242. The frame members provide structural rigidity for the contact module 122, such as to allow the contact module 122 to be mounted to the circuit board 106. The cross-rails 248 provides support for the connecting rails 247. The leads 254 pass through the bottom rail 245, the connecting rails 247, the front rail 246, the closing rail 249 and the inner hub 242. The cross-rails 248 generally extend along the leads 254 but the leads 254 are not received in the cross-rails 248.

In an exemplary embodiment, the dielectric frame 240 includes locating tabs 266 extending from the cross rails 248 into the windows 260. The locating tabs 266 are configured to locate and support the leads 254. The locating tabs 266 are configured to engage the leads 254 to support the leads 254. For example, the locating tabs 266 may include slots or grooves 267 that receive the leads 254 to locate the leads 254 relative to the dielectric frame 240. The locating tabs 266 may support side to side positioning of the leads 254. The locating tabs 266 may control positioning of the leads 254 within the windows 260, such as to support the leads 254 spaced apart from the cross rails 248. In an exemplary embodiment, the leads 254 are completely surrounded by air within the windows 260 (for example, both sides 232, 234 and both inner and outer edges 236, 238 are surrounded by air). In an exemplary embodiment, the leads 254 include notches 268 along edges of the leads 254 opposite the locating tabs 266. The leads 254 are narrower between the inner and outer edges at the notches 268. The notches 268 are compensation features that compensate for portions of the leads 254 passing through the locating tabs 266. For example, because portions of the leads 254 at the locating tabs 266 are surrounded by the plastic material of the dielectric frame 240, the notches 268 reduce the width of the leads 254 at the area of the locating tab 266 to maintain signal integrity along the signal transmission lines.

In an exemplary embodiment, the windows 260 extend entirely through the dielectric frame 240. The windows 260 extend along portions or segments of the leads 254 between the mating portions 250 and the mounting portions 252. In an exemplary embodiment, the windows 260 extend along a majority of the length of the corresponding leads 254. In an exemplary embodiment, the windows 260 have different lengths. For example, the windows 260 closer to the outer rail 244 are longer than the windows 260 closer to the inner hub 242. The longer windows 260 expose greater lengths of the leads 254 than the shorter windows 260. In an exemplary embodiment, the longer windows 260 are provided along the first leads 254*a* and the shorter windows 260 are provided along the second leads 254*b*, while the dielectric frame 240 does not include any windows 260 along the third leads 254*c*. Rather, the third leads 254*c* include trenches 262 along the longer third leads 254*h* and no trenches 262 along the shorter third leads 254*i*. In an exemplary embodiment, a greater number of windows 260 are provided along the first leads 254*a* (for example, four windows 260) as compared to the number of windows 260 provided along the second leads 254*b* (for example, three windows 260) and the third leads 254*c* (for example, zero windows 260). The number and lengths of the windows 260 and the trenches 262 provide electrical compensation for the signal transmission lines, such as to reduce cross-talk, reduce insertion loss, reduce skew, match target impedance, and the like.

In an exemplary embodiment, each of the windows 260 may be stepped such that the windows 260 are wider along the radially outer edge of the window 260 and narrower at the radially inner edge of the window 260. For example, the windows 260 may include steps 269 at one or both ends of the windows 260. The steps 269 are compensation features to improve signal integrity of the contact module 122, such as to compensate for skew. The steps 269 covers the shorter leads 254 (for example, the shorter first lead 254*e*) to allow the windows 260 to be open along longer portions of the longer leads 254 (for example, the longer first lead 254*d*). The windows 260 are stepped to expose longer lengths of the longer first leads 254*d* to air than the lengths of the shorter first leads 254*e*. In the illustrated embodiment, the steps 269 are provided along one of the connecting rails 247; however, the steps 269 may be provided along the other frame members in alternative embodiments.

In an exemplary embodiment, the dielectric frame 240 includes a first side 270 (FIGS. 3 and 4) and a second side 272 (FIGS. 5 and 6) opposite the first side 270. The dielectric frame 240 includes a front 274 and a rear 276 opposite the front 274. The dielectric frame 240 includes a top 278 and a bottom 280 opposite the top 278. The front rail 246 is provided at the front 274. The bottom rail 245 is provided at the bottom 280. The outer rail 244 extends along the rear 276 and the top 278. The inner hub 242 is located generally at the intersection between the front 274 and the bottom 280. The first ground shield 202 (FIG. 2) is coupled to the first side 270 and the second ground shield 204 (FIG. 2) is coupled to the second side 272.

In an exemplary embodiment, the dielectric frame 240 includes a first pocket 282 (FIGS. 3 and 4) at the first side 270 and a second pocket 284 (FIGS. 5 and 6) at the second side 272. The first pocket 282 receives the first ground shield 202 (FIG. 2) and the second pocket 284 receives the second ground shield 204 (FIG. 2). The dielectric frame 240 has a first thickness 286 between the first and second sides 270, 272, such as along the outer rail 244. The dielectric frame 240 has a second thickness 288 at the first and second pockets 282, 284. For example, the bottom rail 245, the front rail 246, the connecting rails 247, the cross rails 248, the closing rail 249 and the inner hub 242 have the second thickness 288.

In an exemplary embodiment, the dielectric frame 240 includes securing posts 290 extending into the first pocket 282 and the second pocket 284. The securing posts 290 extend from corresponding frame members, such as the bottom rail 245, the front rail 246, the connecting rails 247, the cross rails 248, the closing rail 249 and/or the inner hub 242. The securing posts 290 in the first pocket 282 secure the first ground shield 202 to the dielectric frame 240. The securing posts 290 and the second pocket 284 secure the second ground shield 204 to the dielectric frame 240. In various embodiments, the securing posts 290 may be heat stakes. In an exemplary embodiment, the securing posts 290 are shaped to pull the first and second ground shields 202, 204 inward into the first and second pockets 282, 284 against the dielectric frame 240. The securing posts 290 pull the first and second ground shields 202, 204 inward toward the leadframe 230.

In an exemplary embodiment, the dielectric frame 240 includes locating posts 292 extending across the first and second pockets 282, 284 to distal ends 294 of the locating posts 292. The locating posts 292 extend from corresponding frame members, such as the bottom rail 245, the front rail 246, the connecting rails 247, the cross rails 248, the closing rail 249 and/or the inner hub 242. The distal ends 294 are configured to engage the locating posts of an adjacent contact module 122 to locate the contact module 122 relative to the adjacent contact module 122. In various embodiments, the distal ends 294 of the locating posts 292 are coplanar with the first and second sides 270, 272 of the dielectric frame 240.

Returning to FIG. 2, the first and second ground shields 202, 204 are configured to be coupled to the frame assembly 220. The first ground shield 202 includes a main body 300. In the illustrated embodiment, the main body 300 is generally planar. In an exemplary embodiment, the first ground shield 202 is manufactured from a metal material. For example, the metal material may be phosphor-bronze, brass, copper, silver, aluminum, platinum and the like or a combination thereof. In an exemplary embodiment, the first ground shield 202 may be stamped and formed. The first ground shield 202 includes grounding beams 302 extending forward from a front 304 of the main body 300 such that the grounding beams 302 may be loaded into the housing 120 (shown in FIG. 1). The first ground shield 202 includes a plurality of ground pins 306 extending from a bottom 308 of the first ground shield 202. The ground pins 306 are configured to be terminated to the circuit board 106 (shown in FIG. 1). The ground pins 306 may be compliant pins, such as eye-of-the-needle pins, that are press-fit into plated vias in the circuit board 106. Other types of termination means or features may be provided in alternative embodiments to couple the first ground shield 202 to the circuit board 106.

The second ground shield 204 includes a main body 310. In the illustrated embodiment, the main body 310 is generally planar. The second ground shield 204 includes grounding beams 312 extending forward from a front 314 of the main body 310 such that the grounding beams 312 may be loaded into the housing 120 (shown in FIG. 1). The second ground shield 204 includes a plurality of ground pins 316 extending from a bottom 318 of the second ground shield 204. The ground pins 316 are configured to be terminated to the circuit board 106.

In an exemplary embodiment, the first ground shield 202 includes securing posts openings 320 configured to receive corresponding securing posts 290 extending into the first pocket 282 at the first side 270 of the dielectric frame 240. The securing posts 290 extend through the securing posts openings 320 and are configured to be secured to the first ground shield 202. Optionally, the securing posts 290 may be heat staked or riveted to the first ground shield 202 to secure the first ground shield 202 and the first pocket 282. In various embodiments, the securing posts 290 may be coupled to the first ground shield 202 by ultrasonic welding. In an exemplary embodiment, the first ground shield 202 includes locating post openings 322 configured to receive corresponding locating posts 292 extending into the first pocket 282 at the first side 270 of the dielectric frame 240. The distal ends 294 of the locating posts 292 may extend beyond the first ground shield 202, such as to engage corresponding locating posts 292 of the adjacent contact module 122.

In an exemplary embodiment, the second ground shield 204 includes securing posts openings 330 configured to receive corresponding securing posts 290 extending into the second pocket 284 at the second side 272 of the dielectric frame 240. The securing posts 290 extend through the securing posts openings 330 and are configured to be secured to the second ground shield 204. Optionally, the securing posts 290 may be heat staked or riveted to the second ground shield 204 to secure the second ground shield 204 and the second pocket 284. In various embodiments, the securing posts 290 may be coupled to the second ground shield 204 by ultrasonic welding. In an exemplary embodiment, the second ground shield 204 includes locating post openings 332 configured to receive corresponding locating posts 292 extending into the second pocket 284 at the second side 272 of the dielectric frame 240. The distal ends 294 of the locating posts 292 may extend beyond the second ground shield 204, such as to engage corresponding locating posts 292 of the adjacent contact module 122.

Figure 7:
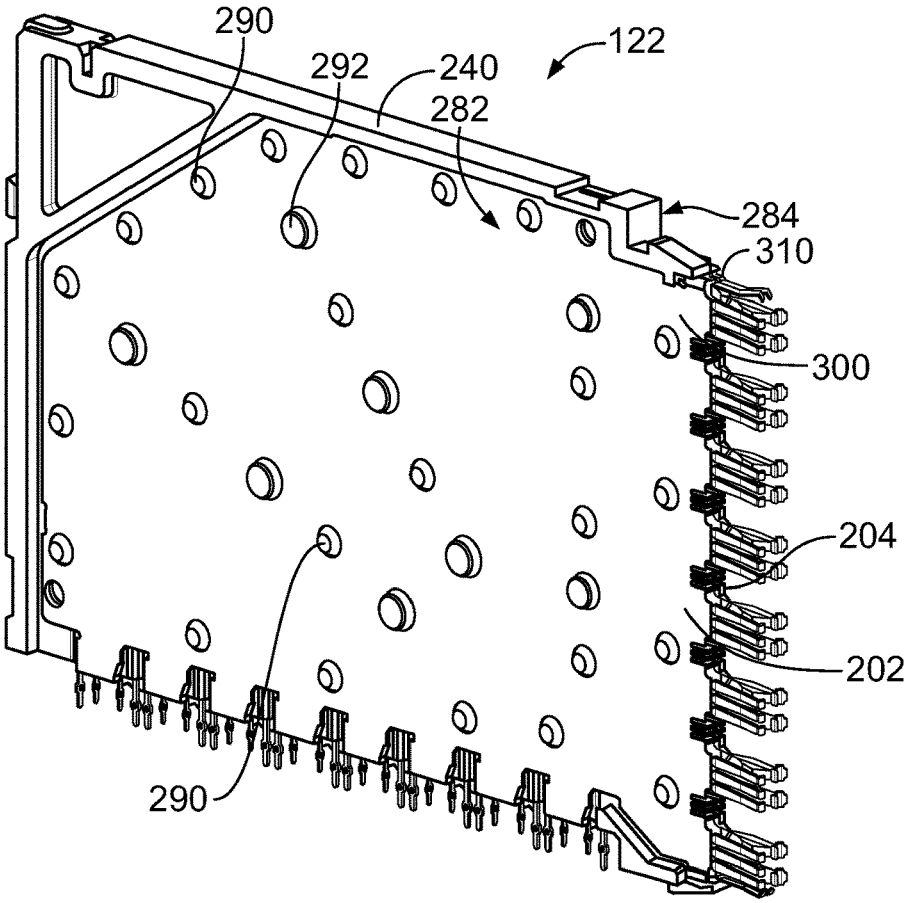
FIG. 7 is a perspective view of the contact module showing first and second ground shields coupled to a dielectric frame of the contact module.
Figure 8:
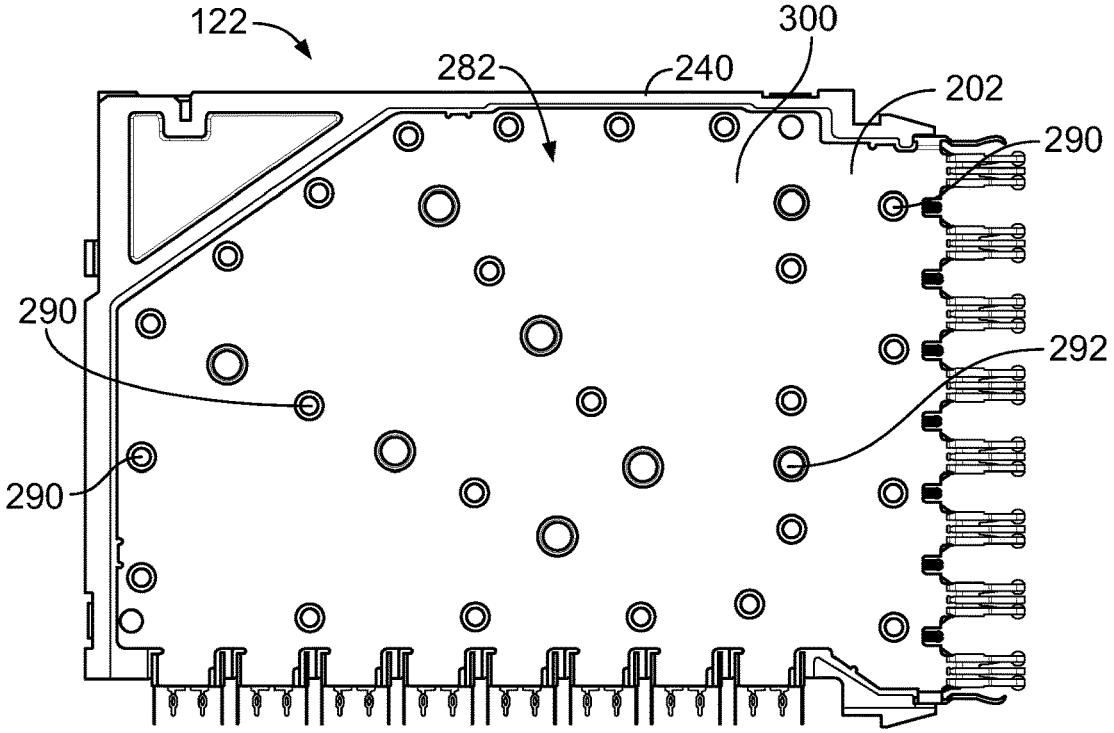
FIG. 8 is a side view of the contact module in an assembled state.

FIG. 7 is a perspective view of the contact module 122 showing the first and second ground shields 202, 204 coupled to the dielectric frame 240. FIG. 8 is a side view of the contact module 122 in an assembled state. The first and second ground shields 202, 204 are received in the first and second pockets 282, 284, respectively, of the dielectric frame 240. The securing posts 290 secure the ground shields 202, 204 to the dielectric frame 240. In an exemplary embodiment, multiple securing posts 290 are provided along the bodies 300, 310 of the ground shields 202, 204 to hold the bodies 300, 310 of the ground shields 202, 204 tightly against the frame members of the dielectric frame 240. The locating posts 292 extend through the ground shields 202, 204 for positioning the contact module 122 relative to adjacent contact modules 122.

Figure 9:
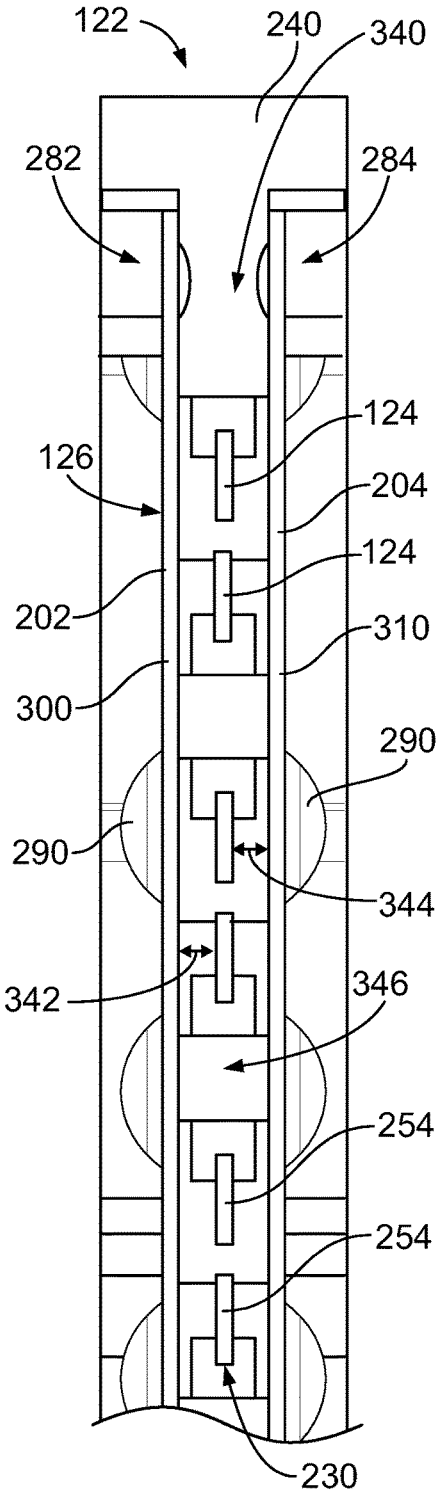
FIG. 9 is a cross-sectional view of a portion of the contact module showing the first and second ground shields coupled to the dielectric frame in accordance with an exemplary embodiment.
Figure 10:
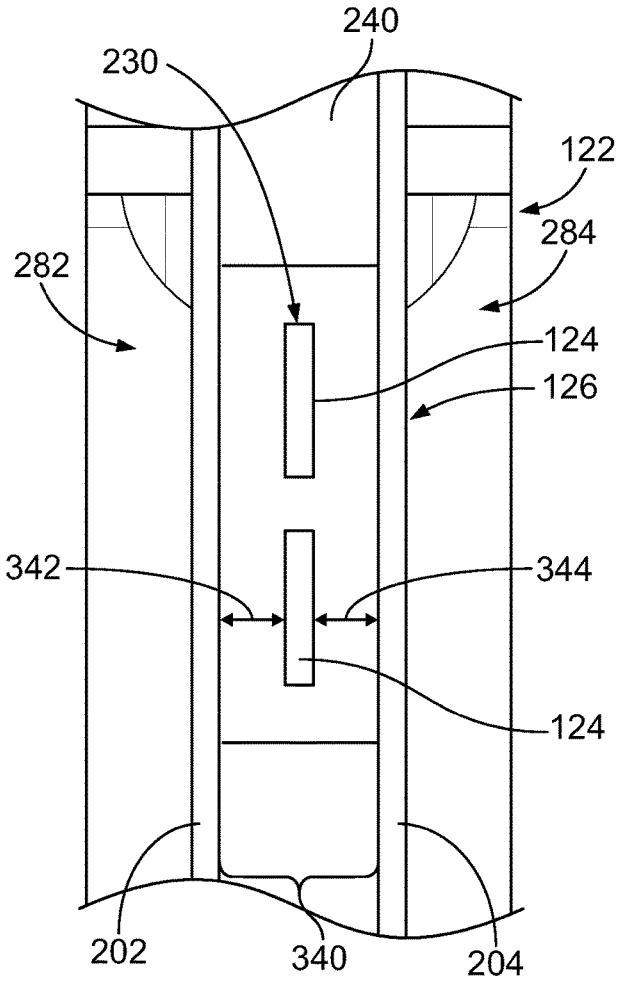
FIG. 10 is an enlarged, cross-sectional view of a portion of the contact module showing the shield structure of the contact module relative to a single pair of the signal contacts in accordance with an exemplary embodiment.

FIG. 9 is a cross-sectional view of a portion of the contact module 122 showing the first and second ground shields 202, 204 coupled to the dielectric frame 240. FIG. 10 is an enlarged, cross-sectional view of a portion of the contact module 122 showing the shield structure 126 of the contact module 122 relative to a single pair of the signal contacts 124. The first and second ground shields 202, 204 are received in the first and second pockets 282, 284, respectively, of the dielectric frame 240. The securing posts 290 are coupled to the ground shields 202, 204 to pull the ground shields 202, 204 inward toward the leadframe 230. As such, air gaps between the ground shields 202, 204 and the dielectric frame 240 are eliminated. The bodies 300, 310 are parallel to each other and form a ground shield gap 340 between the first and second ground shields 202, 204. The leadframe 230 is received in the ground shield gap 340.

In an exemplary embodiment, the leadframe 230 may be centered between the first and second ground shields 202, 204 and the ground shield gap 340. For example, a first spacing 342 between the leads 254 and the first ground shield 202 may be equal to a second spacing 344 between the leads 254 and the second ground shield 204. The first spacing 342 and the second spacing 344 may be tightly controlled and maintained along the entire leadframe plane. The pairs of signal contacts 124 are separated by pair gaps 346. The ground shields 202, 204 provide electrical shielding across the pair gaps 346. In an exemplary embodiment, the ground shields 202, 204 provide electrical shielding across the pair gaps 346 without the first and second ground shields 202, 204 being physically located in the pair gap 346. For example, the ground shields 202, 204 do not include stamped and formed beams or tabs that are bent across the contact module 122 into the pair gap 346. Additional ground features, such as ground tabs and ground skewers are not provided between the first and second ground shields 202, 204 across the pair gap 346. In an exemplary embodiment, the spacing 342, 344 between the leads 254 and the ground shields 202, 204 is relatively small such that the signal contacts 124 are closely coupled to the ground shields 202, 204. The thickness of the dielectric frame 240 at the frame members is relatively thin to closely position the ground shields 202, 204 relative to the signal contacts 124. For example, the signal contacts 124 are more closely coupled to the ground shields 202, 204 than to adjacent pairs of signal contacts 124, thus mitigating crosstalk between the pairs of signal contacts 124.

Figure 11:
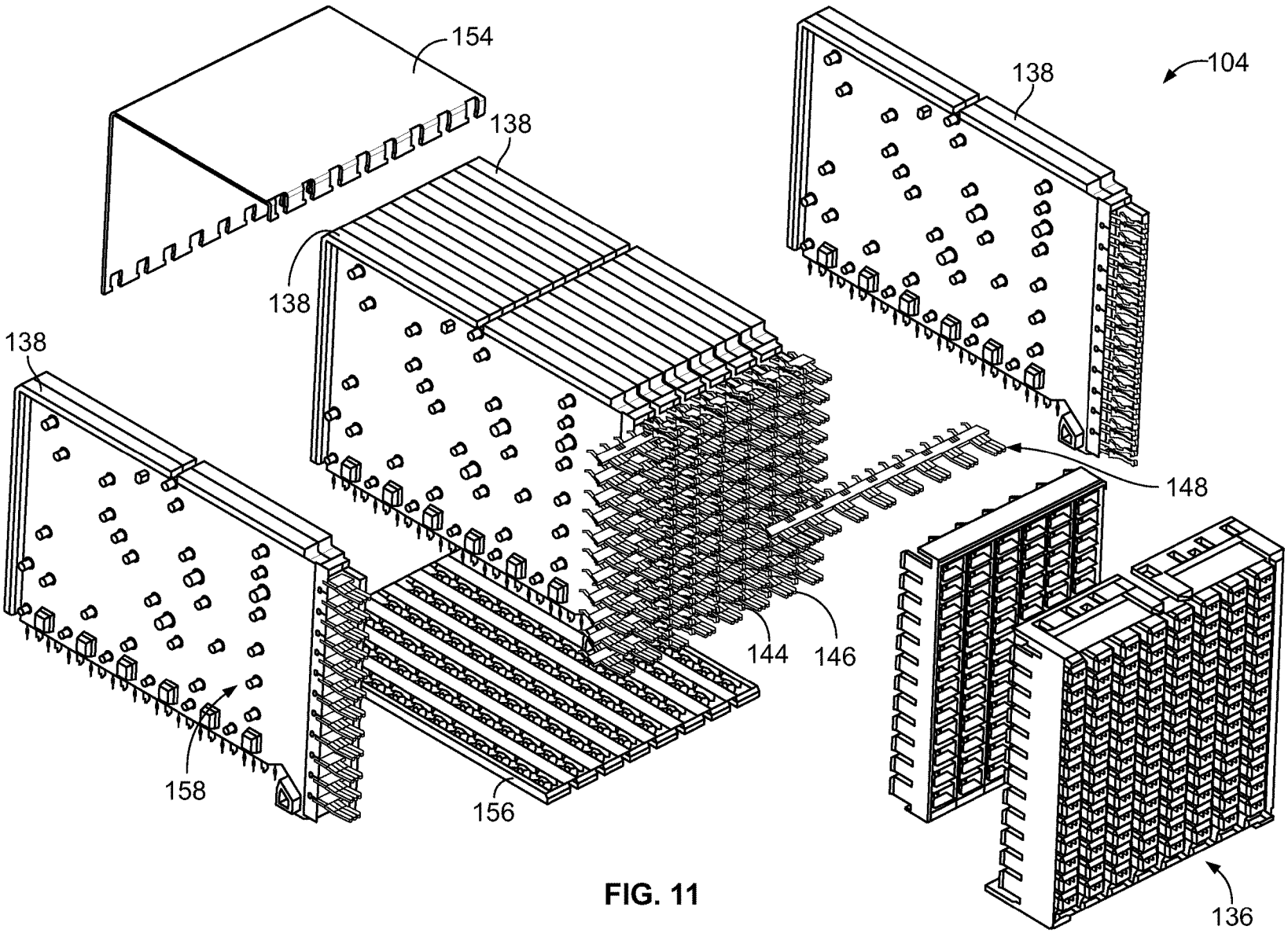
FIG. 11 is an exploded view of a second connector assembly of the electrical connector system in accordance with an exemplary embodiment.

FIG. 11 is an exploded view of a second connector assembly 104 of the electrical connector system 100 in accordance with an exemplary embodiment. The second connector assembly 104 includes the housing 136 holding a plurality of the contact modules 138. In an exemplary embodiment, the second connector assembly 104 includes a contact module holder 154 configured to hold each of the contact modules 138. The second connector assembly 104 includes a contact pin organizer 156 holding pins or tails of the signal contacts 144 and the ground contacts for mounting to the circuit board. The second connector assembly 104 includes the signal contacts 144 arranged as differential pairs. The signal contacts 144 are arranged in rows defining pair-in-row contact modules. The second connector assembly 104 includes a shield structure 158 providing electrical shielding for the signal contacts 144. The ground shields 146 form part of the shield structure 158 and provide electrical shielding between adjacent differential pairs. In the illustrated embodiment, the second connector assembly 104 includes ground bus bars 148 forming parts of the shield structure 158 and the ground shields 146.

Figure 12:
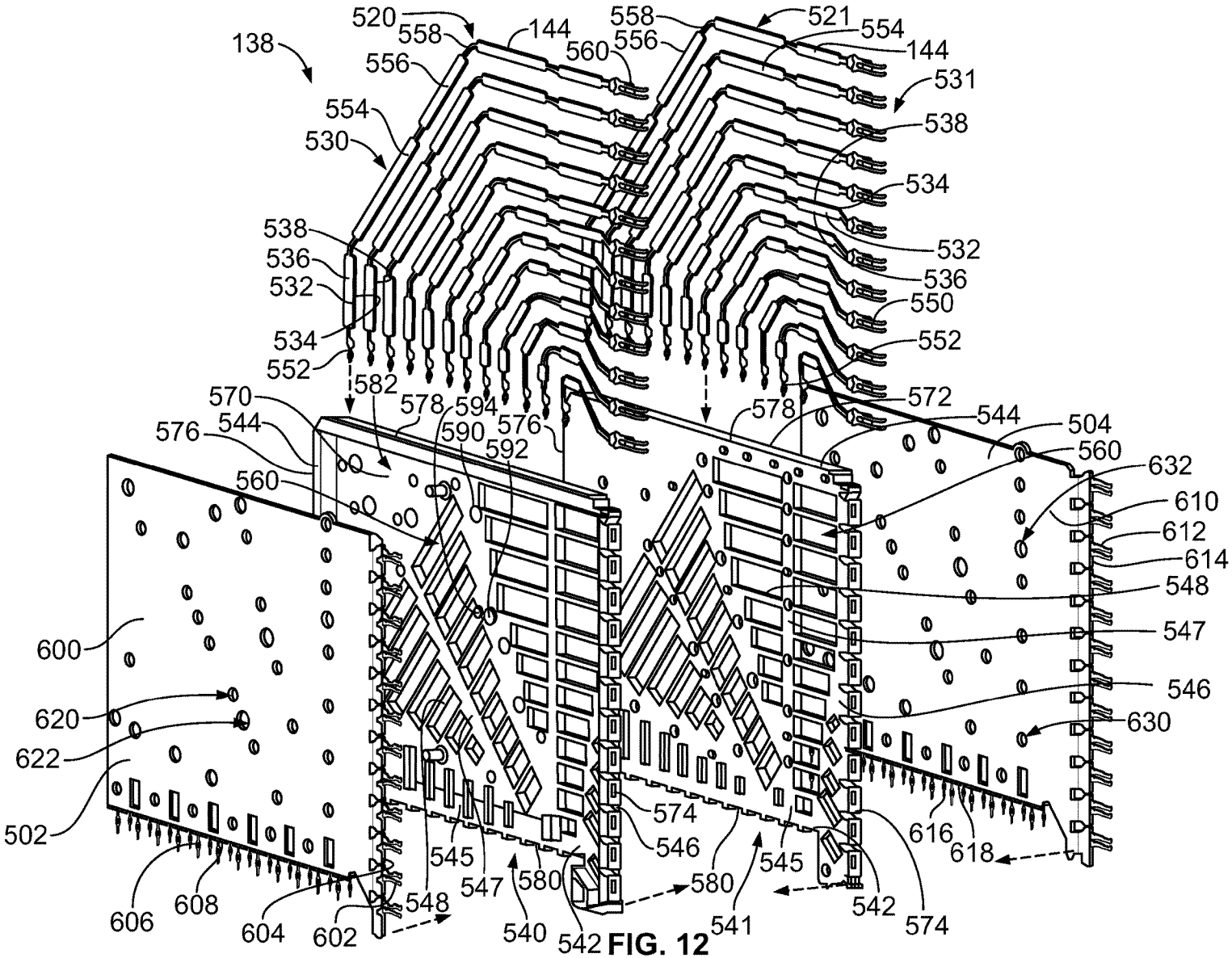
FIG. 12 is an exploded view of a contact module of the second connector assembly in accordance with an exemplary embodiment.
Figure 13:
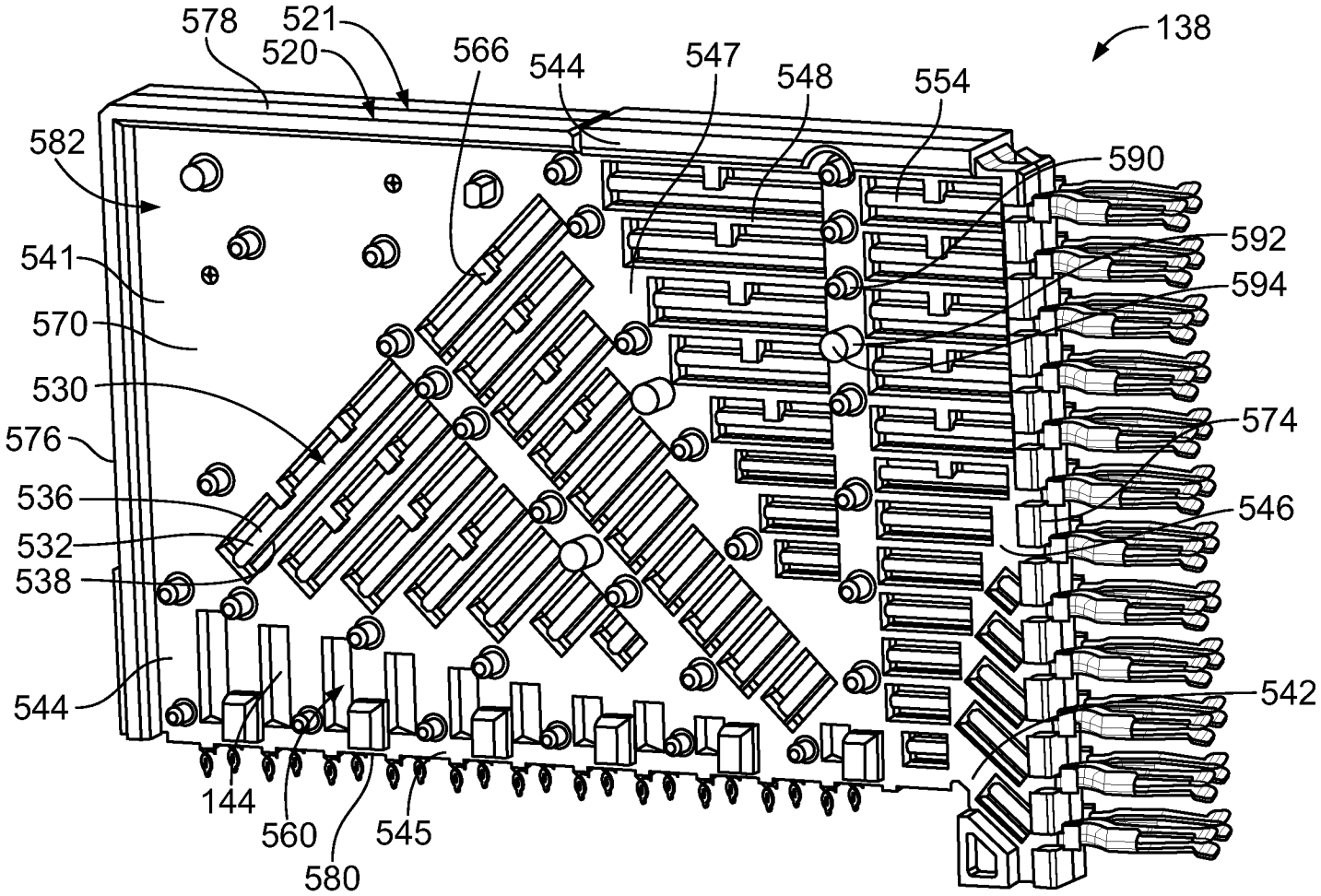
FIG. 13 is a side view of the contact module in accordance with an exemplary embodiment.
Figure 14:
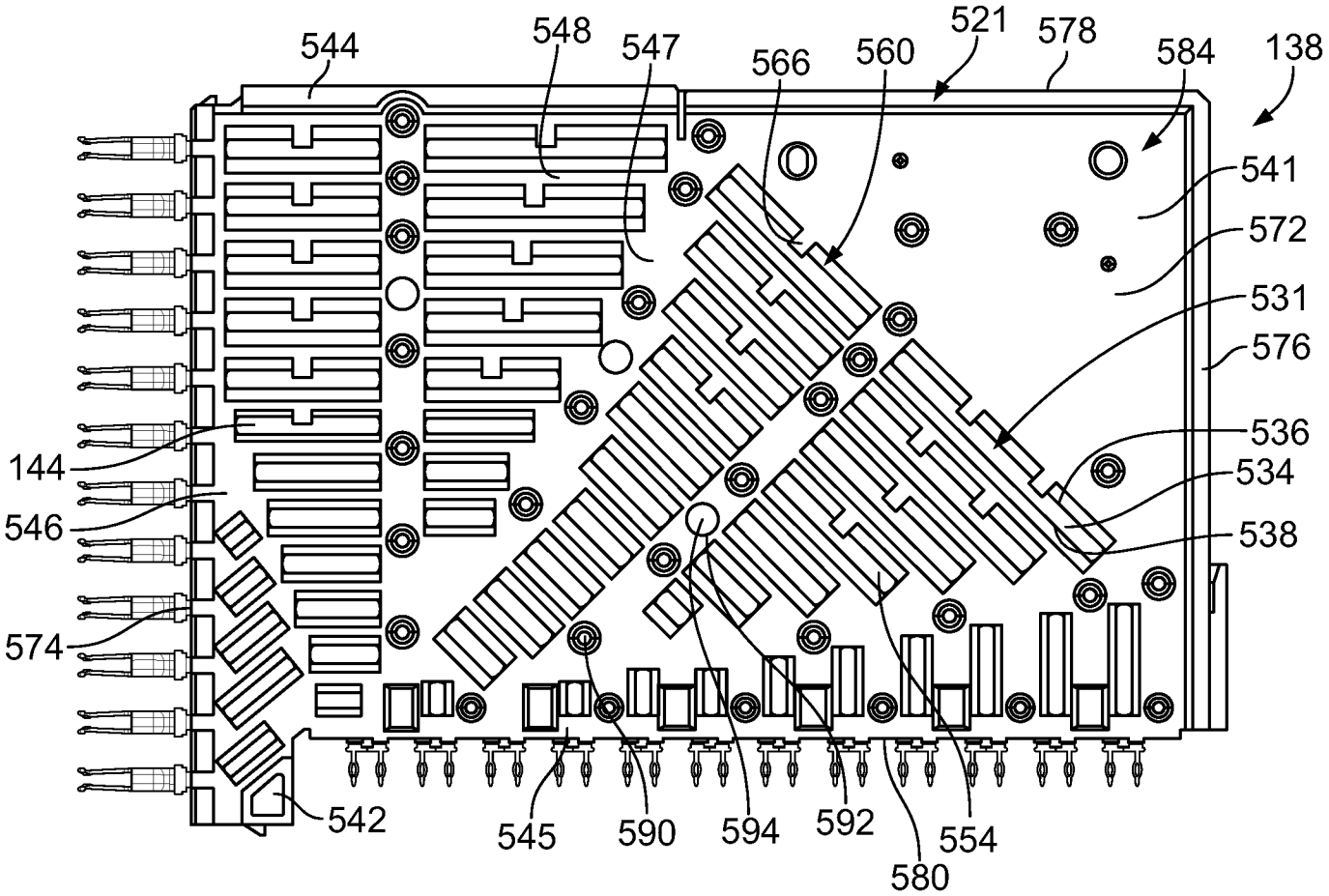
FIG. 14 is a side perspective view of the contact module in accordance with an exemplary embodiment.

FIG. 12 is an exploded view of the contact module 138 in accordance with an exemplary embodiment. FIG. 13 is a side view of a first side of the contact module 138 in accordance with an exemplary embodiment. FIG. 14 is a side perspective view of a second side of the contact module 138 in accordance with an exemplary embodiment.

The shield structure 158 includes a first ground shield 502 (FIG. 12) and a second ground shield 504 (FIG. 12). The first and the second ground shields 502, 504 electrically connect the contact module 138 to the first connector assembly 102 (shown in FIG. 1). The first and the second ground shields 502, 504 provide electrical shielding on both sides of the signal contacts 144. In an exemplary embodiment, the first and second ground shields 502, 504 are configured to be closely coupled to the signal contacts 144 to provide electrical shielding between pairs of the signal contacts 144 without being physically located between the pairs of signal contacts 144. The first ground shield 502 is provided at a first side of the contact module 122 and the second ground shield 504 is provided at a second side of the contact module 122. In various embodiments, the first ground shield 502 is coupled to the first side of the contact module 122 and the second ground shield 504 is coupled to the second side of the contact module 122.

The contact module 138 includes first and second frame assemblies 520, 521. The first frame assembly 520 includes a first leadframe 530 and a first dielectric frame 540. The second frame assembly 521 includes a second leadframe 531 and a second dielectric frame 541. The frame assemblies 520, 521 are arranged side-by-side to form the contact module 138. The leadframes 530, 531 define the signal contacts 144. The leadframes 530, 531 are stamped and formed structures. The dielectric frames 540, 541 surround and support the signal contacts 144 of the leadframes 530, 531, respectively. For example, the dielectric frames 540, 541 may be overmolded bodies configured to be overmolded around the leadframes 530, 531. Other manufacturing processes may be utilized. The signal contacts 144 are shaped and positioned for enhanced electrical performance at high data speed, such as to reduce cross-talk, reduce insertion loss, reduce skew, match target impedance, and the like. In an exemplary embodiment, the signal contacts 144 of the first frame assembly 520 are arranged side-by-side with the signal contacts 144 of the second frame assembly 521 to form differential pairs of signal contacts. The pairs are arranged in rows. The dielectric frames 540, 541 are positioned relative to the leadframes 530, 531 for enhanced electrical performance at high data speeds, such as to reduce cross-talk, reduce insertion loss, reduce effects of skew, achieve target impedance, and the like.

The dielectric frames 540, 541 may be similar to each other and may include similar features. In an exemplary embodiment, the dielectric frames 540, 541 include frame members holding the signal contacts 144. For example, the dielectric frames 540, 541 each include an inner hub 542 at a radially inner portion (for example, at the intersection of the front and the bottom) of the dielectric frame 540, 541 and an outer rail 544 at a radially outer portion of the dielectric frame 540, 541. The dielectric frames 540, 541 each include a bottom rail 545 between the inner hub 542 and the outer rail 544. The dielectric frames 540, 541 each includes a front rail 546 between the inner hub 542 and the outer rail 544. The dielectric frames 540, 541 may include other frame members extending from the inner hub 542 and/or the outer rail 544 and/or the bottom rail 545 and/or the front rail 546 and/or other frame members to hold the signal contacts 144. For example, the dielectric frames 540, 541 may each include connecting rails 547 extending between the inner hub 542 and the outer rail 544 and cross-rails 548 extending between the connecting rails 547 or between the bottom rail 545 and the connecting rail 547 or between the front rail 546 and the connecting rail 547. The dielectric frames 540, 541 may include closing rails (not shown) completely filling spaces between other rails or frame members. For example, the closing rails may be located at or near the inner hub 542. In an exemplary embodiment, the frame members encase portions or segments of the signal contacts 144 and the dielectric frames 540, 541 include openings that expose portions or segments of the signal contacts 144.

The signal contacts 144 have mating portions 550 configured to extend forward from the front rail 546 and mounting portions 552 configured to extend from the bottom rail 545. The signal contacts 144 include leads 554 extending between the mating portions 550 and the mounting portions 552. The mating portions 550 extend from the dielectric frames 540, 541 for mating with the first connector assembly 102 (shown in FIG. 1). The mounting portions 552 extend from the dielectric frames 540, 541 for mounting to the circuit board 108 (shown in FIG. 1). Each of the lead 554 includes opposite sides 532, 534 and an inner edge 536 opposite an outer edge 538. The signal contacts 144 are arranged in pairs with a first signal contact in each pair being held by the dielectric frame 540 and a second signal contact in each pair being held by the dielectric frame 541. The signal contacts 144 are parallel to each other through the contact module 138.

The dielectric frames 540, 541 includes windows 560 used to expose corresponding leads 554 to air. In an exemplary embodiment, the windows 560 in the first dielectric frame 540 are aligned with and open to the windows 560 in the second dielectric frame 542. In various embodiments, the number of windows 560 and the lengths of the windows 560 may be different for different leads 554.

In an exemplary embodiment, the leads 554 include pads 556 and bridges 558 between the pads 556. The pads 556 are wider than the bridges 558. The pads 556 are located along portions of the leads 554 exposed within the windows 560. The bridges 558 are provided along portions of the leads 554 that extend through the frame members, such as the bottom rail 545, the front rail 546, the connecting rail 547, the closing rail and the inner hub 542. The pads 556 are wider to control impedance due to the lower relative dielectric constant of air compared to plastic. The bridges 558 are narrower to provide compensation along the signal transmission lines where the leads 554 pass through the plastic material of the dielectric frames 540, 541 as opposed to the air in the windows 560.

The windows 560 extend through the dielectric frames 540, 541 between the frame members. The windows 560 are bounded by corresponding frame members, such as the bottom rail 545, the front rail 546, the connecting rail 547, the cross-rail 548, the closing rail and the inner hub 542. The frame members provide structural rigidity for the contact module 138, such as to allow the contact module 138 to be mounted to the circuit board 406. The cross-rails 548 provide support for the connecting rails 547. The leads 554 pass through the bottom rail 545, the connecting rails 547, the front rail 546, the closing rail and the inner hub 542. The cross-rails 548 generally extend along the leads 554 but the leads 554 are not received in the cross-rails 548.

In an exemplary embodiment, the dielectric frames 540, 541 include locating tabs 566 extending from the cross rails 548 into the windows 560. The locating tabs 566 are configured to locate and support the leads 554. The locating tabs 566 are configured to engage the leads 554 to support the leads 554. The locating tabs 566 may support side to side positioning of the leads 554. The locating tabs 566 may control positioning of the leads 554 within the windows 560, such as to support the leads 554 spaced apart from the cross rails 548. In an exemplary embodiment, the leads 554 are completely surrounded by air within the windows 560 (for example, both sides 532, 534 and both inner and outer edges 536, 538 are surrounded by air).

In an exemplary embodiment, the windows 560 extend entirely through the dielectric frames 540, 541. The windows 560 extend along portions or segments of the leads 554 between the mating portions 550 and the mounting portions 552. In an exemplary embodiment, the windows 560 extend along a majority of the length of the corresponding leads 554. In an exemplary embodiment, the windows 560 have different lengths. For example, the windows 560 closer to the outer rail 544 are longer than the windows 560 closer to the inner hub 542. The longer windows 560 expose greater lengths of the leads 554 than the shorter windows 560.

In an exemplary embodiment, the dielectric frames 540, 541 include inner sides facing each other and outer sides facing away from each other. The inner sides abut against each other. The outer side of the first dielectric frame 540 defines a first side 570 of the contact module 138 and the outer side of the second dielectric frame 541 defines a second side 572 of the contact module 138. The dielectric frames 540, 541 each include a front 574 and a rear 576 opposite the front 574. The dielectric frames 540, 541 each include a top 578 and a bottom 580 opposite the top 578. The front rails 546 are provided at the front 574. The bottom rails 545 are provided at the bottom 580. The outer rails 544 extend along the rear 576 and the top 578. The inner hubs 542 are located generally at the intersection between the front 574 and the bottom 580. The first ground shield 502 is provided at a first side of the first dielectric module 540 and the second ground shield 504 is provided at a second side of the first dielectric module 540, and similarly, the first ground shield 502 is provided at a first side of the second dielectric module 541 and the second ground shield 504 is provided at a second side of the second dielectric module 541. For example, the first ground shield 502 is configured to be coupled to the first side 570 of the first dielectric frame 540 and the second ground shield 504 is configured to be coupled to the second side 572 of the second dielectric frame 541.

In an exemplary embodiment, the dielectric frame 540 includes a first pocket 582 at the first side 570 and the dielectric frame 541 includes a second pocket 584 at the second side 572. The first pocket 582 receives the first ground shield 502 and the second pocket 584 receives the second ground shield 504.

In an exemplary embodiment, the dielectric frames 540, 541 includes securing posts 590 extending into the pockets 582, 584. The securing posts 590 extend from corresponding frame members, such as the bottom rail 545, the front rail 546, the connecting rails 547, the cross rails 548, the closing rail and/or the inner hub 542. The securing posts 590 in the first pocket 582 secure the first ground shield 502 to the dielectric frame 540. The securing posts 590 in the second pocket 584 secure the second ground shield 504 to the dielectric frame 541. In various embodiments, the securing posts 590 may be heat stakes. In an exemplary embodiment, the securing posts 590 are shaped to pull the first and second ground shields 502, 504 inward into the first and second pockets 582, 584 against the dielectric frames 540, 541. The securing posts 590 pull the first and second ground shields 502, 504 inward toward the leadframe 530. In various embodiments, the securing posts 590 may be coupled to the ground shields 502, 504 by ultrasonic welding.

In an exemplary embodiment, the dielectric frames 540, 541 includes locating posts 592 extending to distal ends 594. The locating posts 592 extend from corresponding frame members, such as the bottom rail 545, the front rail 546, the connecting rails 547, the cross rails 548, the closing rail and/or the inner hub 542. The distal ends 594 are configured to engage the locating posts of an adjacent contact module 138 to locate the contact module 138 relative to the adjacent contact module 138.

With reference to FIG. 12, the first and second ground shields 502, 504 are configured to be coupled to the frame assemblies 520, 521. The first ground shield 502 includes a main body 600. In an exemplary embodiment, the first ground shield 502 may be stamped and formed. The first ground shield 502 includes grounding beams 602 extending forward from a front 604 of the main body 600. The first ground shield 502 includes a plurality of ground pins 606 extending from a bottom 608 of the first ground shield 502. The ground pins 606 are configured to be terminated to the circuit board 106 (shown in FIG. 1).

The second ground shield 504 includes a main body 610. In the illustrated embodiment, the main body 610 is generally planar. The second ground shield 504 includes grounding beams 612 extending forward from a front 614 of the main body 610. The second ground shield 504 includes a plurality of ground pins 616 extending from a bottom 618 of the second ground shield 504. The ground pins 616 are configured to be terminated to the circuit board 106.

In an exemplary embodiment, the first ground shield 502 includes securing posts openings 620 configured to receive corresponding securing posts 590 extending into the first pocket 582 at the first side 570 of the dielectric frame 540. The securing posts 590 extend through the securing posts openings 620 and are configured to be secured to the first ground shield 502. In an exemplary embodiment, the first ground shield 502 includes locating post openings 622 configured to receive corresponding locating posts 592 extending into the first pocket 582 at the first side 570 of the dielectric frame 540.

In an exemplary embodiment, the second ground shield 504 includes securing posts openings 630 configured to receive corresponding securing posts 590 extending into the second pocket 584 at the second side 572 of the dielectric frame 540. The securing posts 590 extend through the securing posts openings 630 and are configured to be secured to the second ground shield 504. In an exemplary embodiment, the second ground shield 504 includes locating post openings 632 configured to receive corresponding locating posts 592 extending into the second pocket 584 at the second side 572 of the dielectric frame 540.

Figure 15:
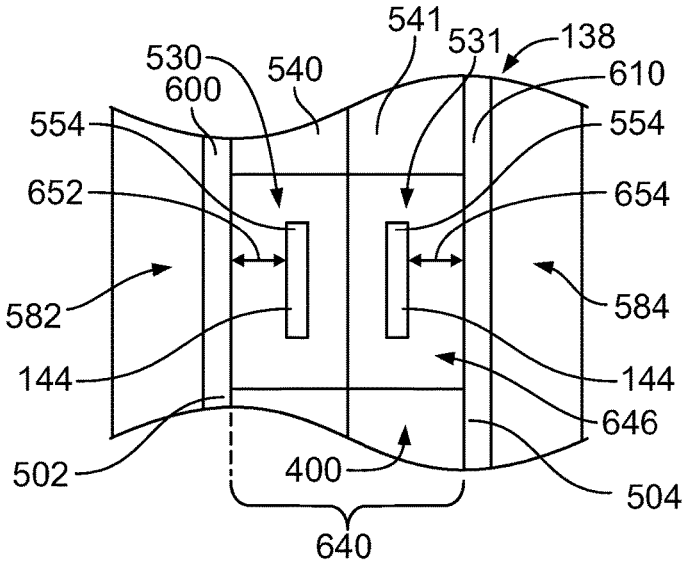
FIG. 15 is a cross-sectional view of a portion of the contact module in accordance with an exemplary embodiment.

FIG. 15 is a cross-sectional view of a portion of the contact module 138 showing the first and second ground shields 502, 504 coupled to the dielectric frame 540. The first and second ground shields 502, 504 are received in the first and second pockets 582, 584 of the dielectric frames 540, 541. The securing posts 590 are coupled to the ground shields 502, 504 to pull the ground shields 502, 504 inward toward the leadframes 530, 531. As such, air gaps between the ground shields 502, 504 and the dielectric frames 540, 541 are eliminated. In various embodiments, the securing posts 590 may be coupled to the ground shields 502, 504 by ultrasonic welding. The bodies 600, 610 are parallel to each other and form a ground shield gap 640 between the first and second ground shields 502, 504. The leadframes 530, 531 are received in the ground shield gap 640. The spacing between the leadframes 530, 531 and the ground shields 502, 504 may be tightly controlled and maintained along the leadframe planes. The leads 554 of the first leadframe 530 are spaced from the first ground shield 502 by a first spacing 652 and the leads 554 of the second leadframe 531 are spaced from the second ground shield 504 by a second spacing 654. The first spacing 652 may be equal to the second spacing 654. The first spacing 652 and the second spacing 654 may be tightly controlled and maintained along the entire leadframe plane. In various embodiments, securing posts may pull the dielectric frames 540, 541 together when assembled to tightly control the air gap or spacing between the dielectric frames 540, 541.

Each pair of signal contacts 144 is located between the ground shields 502, 504. The pairs of signal contacts 144 are separated by pair gaps 646. The ground shields 502, 504 provide electrical shielding across the pair gaps 646. In an exemplary embodiment, the ground shields 502, 504 provide electrical shielding across the pair gaps 646 without the first and second ground shields 502, 504 being physically located in the pair gaps 646. For example, the ground shields 502, 504 do not include stamped and formed beams or tabs that are bent across the contact module 138 into the pair gap 646. Additional ground features, such as ground tabs are ground skewers are not provided between the first and second ground shields 502, 504 across the pair gap 646. In an exemplary embodiment, the spacing between the leads 554 and the ground shields 502, 504 is relatively small such that the signal contacts 144 are closely coupled to the ground shields 502, 504. The thicknesses of the dielectric frames 540, 541 are relatively thin to closely position the ground shields 502, 504 relative to the signal contacts 144. For example, the signal contacts 144 are more closely coupled to the ground shields 502, 504 than to adjacent pairs of signal contacts 144, thus mitigating crosstalk between the pairs of signal contacts 144.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A contact module for a connector assembly comprising:

a leadframe having first signal contacts, each first signal contact having a mating end configured to be mated to a mating connector assembly and a mounting end configured to be terminated to a circuit board, each first signal contact having a first lead extending between the mating end and the mounting end, the first lead having sides extending between an inner edge and an outer edge;

a dielectric frame supporting the leadframe, the dielectric frame manufactured from a dielectric material, the dielectric frame having a first side and a second side, the dielectric frame having windows extending through the dielectric frame between the first side and the second side, the windows exposing to air the sides, the inner edges and the outer edges of the corresponding first leads along a majority of lengths of the first leads to control impedance due to lower relative dielectric constant of air compared to the dielectric material of the dielectric frame; and a shield structure having a first ground shield at the first side and a second ground shield at the second side, the first and second ground shields providing electrical shielding for the first signal contacts.

2. The contact module of claim 1, wherein the first signal contacts are arranged in pairs, each window exposes both of the first leads of the corresponding pair of first signal contacts.

3. The contact module of claim 1, wherein each first lead passes through at least two of the windows between the mating end and the mounting end.

4. The contact module of claim 1, wherein the dielectric frame includes locating tabs extending into the windows to locate the first leads in the window, the locating tabs engaging both sides of the first leads to locate the first leads between the first and second ground shields.

5. The contact module of claim 4, wherein the first leads include notches aligned with the locating tabs along the first leads such that the first leads are narrower between the inner edges and the outer edges at the locating tabs.

6. The contact module of claim 1, wherein the dielectric frame includes securing posts extending from the first and second sides, the first ground shield including securing post openings receiving corresponding securing posts, the second ground shield including securing post openings receiving corresponding securing posts.

7. The contact module of claim 6, wherein the securing posts are coupled to the first and second ground shields to hold the first and second ground shields.

8. The contact module of claim 1, wherein the dielectric frame includes an inner hub and an outer rail, the dielectric frame having connecting rails extending between the inner hub and the outer rail, the dielectric frame having cross-rails between the connecting rails, the windows being bounded by corresponding connecting rails and cross-rails, the dielectric frame having first securing posts extending from the inner hub, the outer rail, and the connecting rails, the dielectric frame having second securing posts extending from the inner hub, the outer rail, and the connecting rails, the first ground shield including securing post openings receiving first securing posts, the second ground shield including securing post openings receiving second securing posts.

9. The contact module of claim 1, wherein the first and second ground shields are separated by a ground shield gap, the leadframe being received in the ground shield gap, the ground shields providing electrical shielding for the first signal contacts across the ground shield gap.

10. The contact module of claim 1, wherein the first signal contacts are arranged in pairs, the pairs of first signal contacts are separated by pair gaps, the first and second ground shields providing electrical shielding across the pair gaps without the first and second ground shields being physically located in the pair gap.

11. The contact module of claim 1, wherein the dielectric frame includes locating posts extending to distal ends, the distal ends of the locating posts being coplanar with the first and second sides of the dielectric frame, the distal ends being configured to engage the locating posts of an adjacent contact module to locate the contact module relative to the adjacent contact module.

12. The contact module of claim 1, wherein the first signal contacts are arranged in pairs, each pair of the first signal contacts includes a longer first lead and a shorter first lead, the windows being stepped to expose longer lengths of the longer first leads to air than the shorter first leads.

13. The contact module of claim 1, wherein the leadframe includes second signal contacts arranged in pairs, each second signal contact having a mating end configured to be mated to the mating connector assembly and a mounting end configured to be terminated to the circuit board, each second signal contact having a second lead extending between the mating end and the mounting end, the second lead having sides extending between an inner edge and an outer edge, the dielectric frame having fewer windows along each of the second leads than each of the first leads.

14. The contact module of claim 13, wherein the leadframe includes third signal contacts arranged in pairs, each third signal contact having a mating end configured to be mated to the mating connector assembly and a mounting end configured to be terminated to the circuit board, each third signal contact having a third lead extending between the mating end and the mounting end, the third lead having sides extending between an inner edge and an outer edge, the dielectric frame being devoid of windows along the third leads.

15. The contact module of claim 1, further comprising a second leadframe having second signal contacts aligned with first signal contacts of the first leadframe in pairs, each second signal contact having a mating end configured to be mated to the mating connector assembly and a mounting end configured to be terminated to the circuit board, each second signal contact having a second lead extending between the mating end and the mounting end, the second lead having sides extending between an inner edge and an outer edge, the second dielectric frame supporting the second leadframe, the second dielectric frame having an inner side and an outer side, the inner side of the second dielectric frame facing the second side of the first dielectric frame, the second dielectric frame having windows extending through the second dielectric frame between the inner side and the outer side, the windows of the second dielectric frame exposing to air the sides, the inner edges and the outer edges of the corresponding second leads along a majority of lengths of the second leads, the windows of the second dielectric frame being aligned with and open to the windows of the first dielectric frame, wherein the first ground shield is coupled to the first side of the first dielectric frame and the second ground shield is coupled to the outer side of the second dielectric frame, the first and second ground shields providing electrical shielding for the first and second signal contacts.

16. A contact module for a connector assembly comprising:

a leadframe having first signal contacts arranged in pairs, each first signal contact having a mating end configured to be mated to a mating connector assembly and a mounting end configured to be terminated to a circuit board, each first signal contact having a first lead extending between the mating end and the mounting end, the first lead having sides extending between an inner edge and an outer edge;

a dielectric frame supporting the leadframe, the dielectric frame having a first side and a second side, the dielectric frame having an inner hub and an outer rail, the dielectric frame having connecting rails extending between the inner hub and the outer rail, the dielectric frame having cross-rails between the connecting rails, the dielectric frame having windows extending through the dielectric frame between the first side and the second side, the windows being bounded by corresponding connecting rails and cross-rails, the windows exposing the first leads to air, the dielectric frame having first securing posts at the first side extending from the inner hub, the outer rail, and the connecting rails to distal ends, the dielectric frame having second securing posts at the second side extending from the inner hub, the outer rail, and the connecting rails to distal ends, the dielectric frame including first locating posts at the first side and second locating posts at the second side, the first and second locating posts extending to distal ends, the distal ends of the first locating posts configured to engage locating posts of an adjacent contact module at the first side and the distal ends of the second locating posts configured to engage locating posts of an adjacent contact module at the second side; and a shield structure having a first ground shield at the first side and a second ground shield at the second side, the first ground shield including securing post openings receiving the first securing posts, the second ground shield including securing post openings receiving the second securing posts, the first and second ground shields providing electrical shielding for the first signal contacts.

17. The contact module of claim 16, wherein the dielectric frame includes locating tabs extending into the windows to locate the first leads in the window, the locating tabs engaging both sides of the first leads to locate the first leads between the first and second ground shields, the first leads including notches aligned with the locating tabs along the first leads such that the first leads are narrower between the inner edges and the outer edges at the locating tabs.

18. The contact module of claim 16, wherein the windows exposing to air the sides, the inner edges and the outer edges of the corresponding first leads along a majority of lengths of the first leads.

19. The contact module of claim 16, wherein the first and second ground shields are separated by a ground shield gap, the leadframe being received in the ground shield gap, the ground shields providing electrical shielding for the pairs of first signal contacts across the ground shield gap.

20. The contact module of claim 16, wherein the pairs of first signal contacts are separated by pair gaps, the first and second ground shields providing electrical shielding across the pair gaps without the first and second ground shields being physically located in the pair gap.

21. A contact module for a connector assembly comprising:

a first frame assembly including a first leadframe and a first dielectric frame, the first leadframe having first signal contacts, each first signal contact having a mating end configured to be mated to a mating connector assembly and a mounting end configured to be terminated to a circuit board, each first signal contact having a first lead extending between the mating end and the mounting end, the first lead having sides extending between an inner edge and an outer edge, the first dielectric frame supporting the first leadframe, the first dielectric frame having an inner side and an outer side, the outer side defining a first side of the contact module, the first dielectric frame having windows extending through the first dielectric frame between the inner side and the outer side, the windows of the first dielectric frame exposing to air the sides, the inner edges and the outer edges of the corresponding first leads along a majority of lengths of the first leads to control impedance due to lower relative dielectric constant of air compared to the dielectric material of the first dielectric frame;

a second frame assembly including a second leadframe and a second dielectric frame, the second leadframe having second signal contacts aligned with first signal contacts of the first leadframe in pairs, each second signal contact having a mating end configured to be mated to the mating connector assembly and a mounting end configured to be terminated to the circuit board, each second signal contact having a second lead extending between the mating end and the mounting end, the second lead having sides extending between an inner edge and an outer edge, the second dielectric frame supporting the second leadframe, the second dielectric frame having an inner side and an outer side defining a second side of the contact module, the inner side of the second dielectric frame facing the inner side of the first dielectric frame, the second dielectric frame having windows extending through the second dielectric frame between the inner side and the outer side, the windows of the second dielectric frame exposing to air the sides, the inner edges and the outer edges of the corresponding second leads along a majority of lengths of the second leads to control impedance due to lower relative dielectric constant of air compared to the dielectric material of the second dielectric frame, the windows of the second dielectric frame being aligned with and open to the windows of the first dielectric frame; and a shield structure having a first ground shield coupled to the first side and a second ground shield coupled to the second side, the first and second ground shields providing electrical shielding for the first and second signal contacts.

22. The contact module of claim 21, wherein the first dielectric frame includes first securing posts extending from the first side and the second dielectric frame includes second securing posts extending from the second side, the first ground shield including securing post openings receiving corresponding first securing posts, the second ground shield including securing post openings receiving corresponding second securing posts.

23. The contact module of claim 21, wherein the pairs of first and second signal contacts are separated by pair gaps, the first and second ground shields providing electrical shielding across the pair gaps without the first and second ground shields being physically located in the pair gap.

* * * * *